US009139940B2

(12) United States Patent
Berrigan et al.

(10) Patent No.: US 9,139,940 B2
(45) Date of Patent: Sep. 22, 2015

(54) BONDED NONWOVEN FIBROUS WEBS COMPRISING SOFTENABLE ORIENTED SEMICRYSTALLINE POLYMERIC FIBERS AND APPARATUS AND METHODS FOR PREPARING SUCH WEBS

(75) Inventors: Michael R. Berrigan, Oakdale, MN (US); John D. Stelter, St. Joseph Township, WI (US); Pamela A. Percha, Woodbury, MN (US); Andrew R. Fox, Oakdale, MN (US); William T. Fay, Woodbury, MN (US)

(73) Assignee: 3M Innovative Properties company, St. Paul, MN (US)

( * ) Notice: Subject to any disclaimer, the term of this patent is extended or adjusted under 35 U.S.C. 154(b) by 1446 days.

(21) Appl. No.: 11/461,201

(22) Filed: Jul. 31, 2006

(65) Prior Publication Data

US 2008/0038976 A1 Feb. 14, 2008

(51) Int. Cl.

*D04H 3/14* (2012.01)
*D04H 3/16* (2006.01)
*D04H 3/00* (2012.01)

(52) U.S. Cl.

CPC . *D04H 3/16* (2013.01); *D04H 3/00* (2013.01); *Y10T 428/2481* (2015.01);
CPC ..... *Y10T 428/249953* (2015.04); *Y10T 428/2913* (2015.01); *Y10T 428/2969* (2015.01); *Y10T 442/3325* (2015.04); *Y10T 442/60* (2015.04); *Y10T 442/614* (2015.04); *Y10T 442/619* (2015.04); *Y10T 442/626* (2015.04); *Y10T 442/641* (2015.04); *Y10T 442/68* (2015.04); *Y10T 442/69* (2015.04)

(58) Field of Classification Search

CPC ..... D04H 3/16; D04H 1/54; D04H 3/14; D04H 5/02; D04H 13/002; D04H 1/50; D04H 1/5405; D04H 3/011; D04H 3/033; D04H 3/163; D04H 5/06; D04H 3/00; Y10S 428/903; B32B 27/12; B32B 5/02; B32B 5/22; D01D 5/084; D01D 5/088; D01F 6/62; D01F 8/14; C08L 67/02; C08L 67/00; Y10T 428/2481; Y10T 442/69; Y10T 442/68; Y10T 442/641; Y10T 442/619; Y10T 442/614; Y10T 442/626; Y10T 428/2969; Y10T 428/2913; Y10T 428/249953; Y10T 442/60; Y10T 442/3325

USPC ..... 442/409; 428/196

See application file for complete search history.

(56) References Cited

U.S. PATENT DOCUMENTS

| | | | | |
|---|---|---|---|---|
| 3,692,618 | A | 9/1972 | Dorschner et al. | |
| 3,715,251 | A | 2/1973 | Prentice | |
| 3,971,373 | A | 7/1976 | Braun | |
| 4,118,531 | A | 10/1978 | Hauser | |
| 4,340,563 | A | 7/1982 | Appel et al. | |
| 4,364,156 | A | 12/1982 | Greenway et al. | |
| 4,405,297 | A | 9/1983 | Appel et al. | 425/72 |
| 4,813,948 | A | 3/1989 | Insley | |
| 4,820,459 | A | 4/1989 | Reifenhauser | |
| 4,931,355 | A | 6/1990 | Radwanski et al. | 428/283 |
| 5,079,080 | A | 1/1992 | Schwarz | 428/288 |
| 5,532,050 | A | 7/1996 | Brooks | |
| 5,575,874 | A | 11/1996 | Griesback, III et al. | |
| 5,681,469 | A | 10/1997 | Barboza et al. | 210/503 |
| 5,685,757 | A | 11/1997 | Kirsch et al. | 442/344 |
| 5,707,468 | A | 1/1998 | Arnold et al. | |
| 5,730,821 | A | 3/1998 | Joest et al. | |
| 6,176,955 | B1 | 1/2001 | Haynes et al. | |
| 6,274,238 | B1 | 8/2001 | DeLucia | 428/373 |
| 6,315,806 | B1 | 11/2001 | Torobin et al. | 55/522 |
| 6,607,624 | B2 | 8/2003 | Berrigan et al. | |
| 6,667,254 | B1 * | 12/2003 | Thompson et al. | 442/351 |
| 6,709,996 | B2 | 3/2004 | Mleziva et al. | |
| 6,736,916 | B2 | 5/2004 | Steinke et al. | |
| 6,770,356 | B2 | 8/2004 | O'Donnell et al. | |
| 6,783,574 | B1 | 8/2004 | Angadjivand et al. | |
| 6,827,765 | B2 | 12/2004 | Springett et al. | 96/66 |
| 6,858,297 | B1 | 2/2005 | Shah et al. | |
| 6,916,752 | B2 | 7/2005 | Berrigan et al. | |
| 7,258,758 | B2 | 8/2007 | Collier, IV et al. | |
| 2003/0018310 | A1 | 1/2003 | Allen | |
| 2003/0114066 | A1 | 6/2003 | Clark et al. | 442/361 |

| | | | | |
|---|---|---|---|---|
| 2003/0162457 | A1 | 8/2003 | Berrigan et al. | 442/327 |
| 2004/0255946 | A1 | 12/2004 | Gerson et al. | |
| 2005/0032451 | A1 | 2/2005 | Kritzer et al. | |

FOREIGN PATENT DOCUMENTS

| | | | |
|---|---|---|---|
| EP | 0 799 342 | 10/1997 | |
| JP | 2003-20555 | 1/2003 | |
| JP | 2007-54778 | 3/2007 | B01D 39/16 |
| WO | WO 02/46504 | 6/2002 | D01F 6/62 |
| WO | WO 2007/112877 | 10/2007 | B01D 39/16 |

OTHER PUBLICATIONS

TA Instruments Differential Scanning Calorimeters.
Modulated DSC, TA Instruments Thermal Analysis & Rheology.
The three reversible crystallization and melting processes of semicrystalline macromolecules; B. Wunderlich/Thermochimica Acta 396 (2003) 33-41.
Kinetics of Transitions Involving Condis Crystals; Grebowicz et al., Journal of Polymer Science : Part B: Polymer Physics, vol. 24, 675-685 (1986).
Reversible Melting of Polyethylene Extended-Chain Crystals Detected by Terperature-Modulated Calorimetry; Pak et al., Journal of Polymer Science: Part B: Polymer Physics, vol. 40; 2219-2227 (2002).
Reversible local melting in polymer crystals; Okazaki et al.; Macromol. Rapid Commun. 18, 313-318 (1997).
Specific Reversible Melting of Polymers; Androsch et al.; Journal of Polymer Science: Part B: Polymer Physics, vol. 41, 2049-2051 (2003).
ASTM E 794-01; Standard Test Method for Melting And Crystallization Termperatures by Thermal Analysis.

* cited by examiner

*Primary Examiner* — Elizabeth Cole
(74) *Attorney, Agent, or Firm* — Roger R. Tamte; James A. Baker

(57) ABSTRACT

A method for making a bonded nonwoven fibrous web comprising 1) providing a nonwoven fibrous web that comprises oriented semicrystalline polymeric fibers, and 2) subjecting the web to a controlled heating and quenching operation that includes a) forcefully passing through the web a fluid heated to at least the onset melting temperature of said polymeric material for a time too short to wholly melt the fibers, and b) immediately quenching the web by forcefully passing through the web a fluid at a temperature at least 50° C. less than the Nominal Melting Point of the material of the fibers. The fibers of the treated web generally have i) an amorphous-characterized phase that exhibits repeatable softening (making the fibers softenable) and ii) a crystallite-characterized phase that reinforces the fiber structure during softening of the amorphous-characterized phase, whereby the fibers may be autogenously bonded while retaining orientation and fiber structure. Apparatus for carrying out the method can comprise 1) a conveyor for conveying a web to be treated, 2) a heater mounted adjacent a first side of the conveyor and comprising a) a chamber having a wall that faces the web, b) one or more conduits through which a heated gas can be introduced into the chamber under pressure and c) a slot in said chamber wall through which heated gas flows from the chamber onto a web on the conveyor, 3) a source of quenching gas downweb from the heater on the first side of the conveyor, the quenching gas having a temperature substantially less than that of the heated gas, 4) gas-withdrawal mean disposed on the second side of the conveyor opposite from the heater, the gas-withdrawal means having a portion in alignment with the slot so as to draw heated gas from the slot through the web and also a portion downweb from the slot in alignment with the source of quenching gas so as to draw the quenching gas through the web to quench the web. Flow restrictor means is preferably disposed on the second side of the conveyor in the path of at least one of the heated gas and the quenching gas so as to even the distribution of the gas through the web.

41 Claims, 10 Drawing Sheets

BONDED NONWOVEN FIBROUS WEBS COMPRISING SOFTENABLE ORIENTED SEMICRYSTALLINE POLYMERIC FIBERS AND APPARATUS AND METHODS FOR PREPARING SUCH WEBS

FIELD OF THE INVENTION

This invention relates to fibrous webs that comprise oriented semicrystalline polymeric fibers having unique softening characteristics that provide the webs with enhanced bonding and shaping properties; and the invention further relates to apparatus and methods for preparing such webs.

BACKGROUND OF THE INVENTION

Existing methods for bonding oriented semicrystalline polymeric fibers in a nonwoven fibrous web generally involve some compromise of web properties. For example, bonding of the web may be achieved by calendering the web while it is heated, thereby distorting fiber shape and possibly detracting from other properties such as web porosity or fiber strength. Or bonding may require addition of an extraneous bonding material, with consequent limitations on utility of the web because of the chemical or physical nature of the added bonding material.

SUMMARY OF THE INVENTION

The present invention provides new nonwoven fibrous webs comprising oriented semicrystalline polymeric fibers that are bonded to form a coherent and handleable web and that further may be softened while retaining orientation and fiber structure. Among other advantages, the new nonwoven webs may be shaped and calendered in beneficial ways.

The new webs are provided by a new method that takes advantage of the morphology of oriented semicrystalline polymeric fibers (the class of semicrystalline polymers is well defined and well known and is distinguished from amorphous polymers, which have no detectable crystalline order; crystallinity can be readily detected by differential scanning calorimetry, x-ray diffraction, density, and other methods; "orientation" or "oriented" means that at least portions of the polymeric molecules of the fibers are aligned lengthwise of the fibers as a result of passage of the fibers through equipment such as an attenuation chamber or mechanical drawing machine; the presence of orientation in fibers can be detected by various means including birefringence measurements or wide-angle x-ray diffraction).

Conventional oriented semicrystalline polymeric fibers may be considered to have two different kinds of molecular regions or phases: a first kind of phase that is characterized by the relatively large presence of highly ordered, or strain-induced, crystalline domains, and a second kind of phase that is characterized by a relatively large presence of domains of lower crystalline order (e.g., not chain-extended) and domains that are amorphous, though the latter may have some order or orientation of a degree insufficient for crystallinity. These two different kinds of phases, which need not have sharp boundaries and can exist in mixture with one another, have different kinds of properties. The different properties include different melting and/or softening characteristics: the first phase characterized by a larger presence of highly ordered crystalline domains melts at a temperature (e.g., the melting point of a chain-extended crystalline domain) that is higher than the temperature at which the second phase melts or softens (e.g., the glass transition temperature of the amorphous domain as modified by the melting points of the lower-order crystalline domains). For ease of description herein, the first phase is termed herein the "crystallite-characterized phase" because its melting characteristics are more strongly influenced by the presence of the higher order crystallites, giving the phase a higher melting point than it would have without the crystallites present; the second phase is termed the amorphous-characterized phase because it softens at a lower temperature influenced by amorphous molecular domains or of amorphous material interspersed with lower-order crystalline domains.

The bonding characteristics of conventional oriented semicrystalline polymeric fibers are influenced by the existence of the two different kinds of molecular phases. When the conventional fibers are heated in a conventional bonding operation, the heating operation has the effect of increasing the crystallinity of the fibers, e.g., through accretion of molecular material onto existing crystal structure or further ordering of the ordered amorphous portions. The presence of lower-order crystalline material in the amorphous-characterized phase promotes such crystal growth, and promotes it as added lower-order crystalline material. The result of the increased lower-order crystallinity is to limit softening and flowability of the fibers during a bonding operation.

By the present invention oriented semicrystalline polymeric fibers are subjected to a controlled heating and quenching operation in which the fibers, and the described phases, are morphologically refined to give the fibers new properties and utility. In this heating and quenching operation the fibers are first heated for a short controlled time at a rather high temperature, often as high or higher than the nominal melting point of the polymeric material from which the fibers are made. Generally the heating is at a temperature and for a time sufficient for the amorphous-characterized phase of the fibers to melt or soften while the crystallite-characterized phase remains unmelted (we use the terminology "melt or soften" because amorphous portions of an amorphous-characterized phase generally are considered to soften at their glass transition temperature, while crystalline portions melt at their melting point; the most effective heat treatment in a method of the invention occurs when a web is heated to cause melting of crystalline material in the amorphous-characterized phase of constituent fibers). Following the described heating step, the heated fibers are immediately and rapidly cooled to quench and freeze them in a refined or purified morphological form.

In broadest terms "morphological refining" as used herein means simply changing the morphology of oriented semicrystalline polymeric fibers; but we understand the refined morphological structure of the treated fibers of the invention as follows (we do not wish to be bound by statements herein of our "understanding," which generally involve some theoretical considerations). As to the amorphous-characterized phase, the amount of molecular material of the phase susceptible to undesirable (softening-impeding) crystal growth is not as great as it was before treatment. One evidence of this changed morphological character is the fact that, whereas conventional oriented semicrystalline polymeric fibers undergoing heating in a bonding operation experience an increase in undesired crystallinity (e.g., as discussed above, through accretion onto existing lower-order crystal structure or further ordering of ordered amorphous portions that limits the softenability and bondability of the fibers), the treated fibers of the invention remain softenable and bondable to a much greater degree than conventional untreated fibers; often they can be bonded at temperatures lower than the nominal melting point of the fibers. We perceive that the amorphous-characterized phase has experienced a kind of cleansing or reduction of morphological structure that would lead to undesirable increases in crystallinity in conventional untreated fibers during a thermal bonding operation; e.g., the variety or distribution of morphological forms has been reduced, the morphological structure simplified, and a kind of segregation of the morphological structure into more discernible amorphous-characterized and crystallite-characterized phases has occurred. Treated fibers of the invention are capable of a kind of "repeatable softening," meaning that the fibers, and particularly the amorphous-characterized phase of the fibers, will undergo to some degree a repeated cycle of softening and resolidifying as the fibers are exposed to a cycle of raised and lowered temperature within a temperature region lower than that which would cause melting of the whole fiber.

In practical terms, repeatable softening is indicated when a treated web of the invention (which already generally exhibits a useful bonding as a result of the heating and quenching treatment) can be heated to cause further autogenous bonding of the fibers ("autogenous bonding" is defined as bonding between fibers at an elevated temperature as obtained in an oven or with a through-air bonder without application of solid contact pressure such as in point-bonding or calendering). The cycling of softening and resolidifying may not continue indefinitely, but it is usually sufficient that the fibers may be initially bonded by exposure to heat, e.g., during a heat treatment according to the invention, and later heated again to cause re-softening and further bonding, or, if desired, other operations, such as calendering or re-shaping.

The capability of oriented semicrystalline fibers to soften and autogenously bond at temperatures substantially below their nominal melting point is, so far as known, unprecedented and remarkable. Such a softening opens the way to many new processes and products. One example is the ability to reshape the web, e.g., by calendering it to a smooth surface or molding it to a nonplanar shape as for a face mask. Another example is the ability to bond a web at lower temperatures, which for example may allow bonding without causing some other undesirable change in the web. Preferably reshaping or bonding can be performed at a temperature 15° C. below the nominal melting point of the polymeric material of the fibers. In many embodiments of the invention we have succeeded in reshaping or further bonding of the web at temperatures 30° C., or even 50° C., less than the nominal melting point of the fibers. Even though a low bonding temperature or a low molding temperature (temperature at which adjacent fibers coalesce sufficiently to adhere together and give a web coherency or cause it to assume the shape of the mold) is possible, for other reasons the web may be exposed to higher temperatures, e.g., to compress the web or to anneal or thermally set the fibers.

In one aspect the invention provides a method for molding a web comprised of oriented semicrystalline monocomponent polymeric fibers, the method comprising a) morphologically refining the web in a heating and quenching operation so that the web is capable of developing autogenous bonds at a temperature less than the Nominal Melting Point of the fibers; b) placing the web in a mold; and c) subjecting the web to a molding temperature effective to lastingly convert the web into the mold shape.

Given the role of the amorphous-characterized phase in achieving bonding of fibers, e.g., providing the material of softening and bonding of fibers, we sometimes call the amorphous-characterized phase the "bonding" phase.

The crystallite-characterized phase of the fiber has its own different role, namely to reinforce the basic fiber structure of the fibers. The crystallite-characterized phase generally can remain unmelted during a bonding or like operation because its melting point is higher than the melting/softening point of the amorphous-characterized phase, and it thus remains as an intact matrix that extends throughout the fiber and supports the fiber structure and fiber dimensions. Thus, although heating the web in an autogenous bonding operation will cause fibers to adhere or weld together by undergoing some flow into intimate contact or coalescence at points of fiber intersection ("bonding" fibers means adhering the fibers together firmly, so they generally do not separate when the web is subjected to normal handling), the basic discrete fiber structure is retained over the length of the fibers between intersections and bonds; preferably, the cross-section of the fibers remains unchanged over the length of the fibers between intersections or bonds formed during the operation. Similarly, although calendering of a web of the invention may cause fibers to be reconfigured by the pressure and heat of the calendering operation (thereby causing the fibers to permanently retain the shape pressed upon them during calendering and make the web more uniform in thickness), the fibers generally remain as discrete fibers with a consequent retention of desired web porosity, filtration, and insulating properties.

Given the reinforcing role of the crystallite-characterized phase as described, we sometimes refer to it as the "reinforcing" phase or "holding" phase. The crystallite-characterized phase also is understood to undergo morphological refinement during a treatment of the invention, for example, to change the amount of higher-order crystalline structure.

One tool used to examine changes occurring within fibers treated according to the invention is differential scanning calorimetry (DSC). Generally, a test sample (e.g., a small section of the test web) is subjected to two heating cycles in the DSC equipment: a "first heat," which heats the test sample as received to a temperature greater than the melting point of the sample (as determined by the heat flow signal returning to a stable base line); and a "second heat," which is like the first heat, but is conducted on a test sample that has been melted in a first heat and then cooled, typically to lower than room temperature. The first heat measures characteristics of a nonwoven fibrous web of the invention directly after its completion, i.e., without it having experienced additional thermal treatment. The second heat measures the basic properties of the material of the web, with any features that were imposed on the basic material by the processing to which the material was subjected during manufacture and treatment of a web of the invention having been erased by the melting of the sample that occurred during the first heat.

Generally, we conduct DSC testing on Modulated Differential Scanning Calorimetry™ (MDSC™) equipment. Among other things, MDSC™ testing produces three different plots or signal traces as shown in FIG. 6: Plot A, a "nonreversing heat flow" plot (which is informative as to kinetic events occurring within the test sample); Plot B, a "reversing heat flow" plot (e.g., related to heat-capacity); and Plot C, a "total heat flow" plot like the typical DSC plot and showing the net heat flow occurring in the sample as it is heated through the DSC test regime. (On all the DSC plots presented herein the abscissa is marked in units of temperature, degrees Centigrade, and the ordinates are in units of thermal energy, watts/gram; the leftmost ordinate in FIG. 6 is for the total heat flow plot; the leftmost of the two righthand ordinates is for the nonreversing heat flow plot; and the rightmost of the ordinate scales is for the reversing heat flow plot.) Each separate plot reveals different data useful in characterizing fibers and webs of the invention. For example, Plot A is especially useful because of its more clear identification of cold-crystallization peaks and crystal-perfection peaks (because these are kinetic effects best represented in the nonreversing heat flow signal).

Some of the more or less discernible data points in the form of deflections or peaks that may appear on the DSC plots at different temperatures depending on the polymeric composition of a fiber being tested and the condition of the fiber (the result of processes or exposures the fiber has experienced) are illustrated in the several plots of FIG. 6. Thus, the representative Plot C in FIG. 6, a first-heat, total-heat-flows plot for a representative semicrystalline polymer, could reveal: $T_{CC}$, a "cold-crystallization peak," showing an exotherm occurring as molecules in the sample align into a crystal arrangement; and $T_M$ identifying on this plot the endothermic peak showing melting of the test fiber. Plot A of FIG. 6 reveals an exothermic peak $T_{CC}$ reflecting cold-crystallization, and $T_{CP}$, a "crystal-perfection peak," reflecting an exotherm occurring as crystal structure in the sample further rearranges into a more perfect or larger crystal structure. Plot B is generally used to determine the glass transition temperature $T_g$ of the polymer, though a deflection representative of $T_g$ also appears on Plot C.

FIG. 7 shows both the first-heat and the second-heat total-heat-flow plots (Plots A and B, respectively) for a representative material of the invention (in this case for Example 5). One useful item of information obtained from the second-heat plot (Plot B) is information on the basic melting point of the polymeric material used in making a nonwoven web of the invention. Generally, for semicrystalline polymers used in making nonwoven webs of the invention, the basic melting point is seen as an endotherm on the second-heat plot or scan occurring at about the temperature where the most ordered crystals of the sample melt. On FIG. 7 the peak M is the melting point peak for the test sample, and the peak maximum M' is regarded as the nominal melting point for the sample. (A material specification for a commercial polymer would typically list the temperature M' as the melting point for the commercial material.) For purposes herein, the "Nominal Melting Point" for a polymer or a polymeric fiber is defined as the peak maximum of a second-heat, total-heat-flow DSC plot in the melting region of the polymer or fiber if there is only one maximum in that region; and, if there is more than one maximum indicating more than one melting point (e.g., because of the presence of two distinct crystalline phases), as the temperature at which the highest-amplitude melting peak occurs.

Another useful item of information is the temperature at which melting of a test sample begins, i.e., the onset temperature of melting of the sample. This temperature is defined for purposes herein as the point where the tangent drawn from the point of maximum slope of the melting peak on the total-heat-flow plot intersects with the baseline of the plot (BL in FIG. 7; the line where there are neither positive nor negative heat flows). In FIG. 7 the onset melting temperature ($T_O$) for the polymeric material of Example 5 is shown on Plot B (preferably $T_O$ is determined from the second-heat plot). To effectively heat-treat fibers according to the invention we prefer to expose the fibers to a fluid heated to a temperature at which crystalline material within the amorphous-characterized phase melts, which temperature can generally be identified as a temperature greater than the onset melting temperature.

Another useful item of information, especially useful in describing treated nonwoven webs of the invention, is received from the first-heat nonreversing-heat-flow signal. This item of information is conveyed by exothermic peaks in the signal occurring at and around the melting of, respectively, the amorphous-characterized phase and the crystallite-characterized phase. These exothermic peaks, often referred to as the crystal-perfection peaks, represent thermal energy produced as molecules within the respective phases rearrange during heating of the test sample. In at least slow-crystallizing materials such as polyethylene terephthalate there are generally two distinguishable crystal-perfection peaks, one associated with the amorphous-characterized phase and the other associated with the crystallite-characterized phase (note that a peak may be manifested as a shoulder on another generally larger peak). With respect to the amorphous-characterized phase, as a test sample is heated during a DSC test and approaches the melting/softening point of molecular material associated with the amorphous-characterized phase, that molecular material is increasingly free to move and become more aligned with the crystalline structure of the phase (mostly lower-order crystalline material). As it rearranges and grows in crystallinity, thermal energy is given off, and the amount of thermal energy given off varies as the test temperature increases toward the melting point of crystallites in the amorphous-characterized phase. Once the melting point for the amorphous-characterized phase is reached and exceeded, the molecular material of the phase melts and the thermal energy given off declines, leaving a peak maximum occurring at a temperature that may be seen as a distinguishing characteristic of the state of the molecular material of the amorphous-characterized phase of the test nonwoven web.

A similar phenomenon occurs for the crystallite-characterized phase, and a peak maximum develops that is characteristic of the state of the molecular material of the crystallite-characterized phase. This peak occurs at a temperature higher than the temperature of the peak maximum for the amorphous-characterized phase.

Not all the above-described peaks or indications will occur for all polymers and all conditions of a fiber, and some judgment may be needed to interpret the information. For example, nylon can undergo changes during thermal processing such as experienced in DSC testing because of rather strong hydrogen bonding between adjacent molecules, with the result that the melting point of a nylon test sample may be raised during the first-heat DSC test. The higher melting point becomes an artifact of the test that must be accounted for (discussed further below).

Some observations we have made as to nonwoven webs of the invention tested by MDSC™, which we understand as alternative indications of morphological refinement occurring during treatment according to the invention, are as follows:

1. One observation seen in the first-heat, nonreversing-heat-flow scan concerns the temperature spread between the maxima for the crystal perfection peaks of, respectively, the crystallite-characterized phase and the amorphous characterized phase. In FIG. 8 peak $T_{CP1}$ represents the crystal perfection peak for the crystallite-characterized (reinforcing) phase of the test fiber, and peak $T_{CP2}$ represents the crystal perfection peak for the amorphous-characterized (bonding) phase of the test fiber (as stated above, peaks may be so close to one another that one is manifested as a shoulder on the other peak). Effective heat treatments of the invention often appear to result in the temperature difference between these two peak maxima lying within a certain range, which varies with the kind of polymer. For example, with polyethylene terephthalate fibers, the temperature difference between the two peak maxima has generally been at least about 5° C. and up to about 10° C.; with nylon fibers it has generally been between about 6 to 9° C.; and with polypropylene fibers the temperature difference between these two peak maxima has generally been at least 4° C. We understand reasons for these limited ranges as follows. A spread greater than that indicated may occur because the crystal perfection maximum of the amorphous-characterized phase is at too low a temperature, resulting from insufficient morphological cleansing of the amorphous-characterized phase; this means there is too great a disorder remaining in the phase, causing reordering during DSC to occur at too low a temperature. On the other hand, a temperature spread less than indicated may indicate that the heat treatment caused damage to the crystallite-characterized phase of the fiber, e.g., because the fiber was treated at too high a temperature or for too long, causing undesirable reordering of the crystallite-characterized phase.

2. For fast-crystallizing polymers such as polyethylene and polypropylene, morphological refinement according to the invention is often revealed in a nonreversing heat flow curve by either or both a) a reduction in the so-called crystal-perfection peak (i.e., a reduction in the height or amplitude of the peak—i.e., the deflection from the baseline—in comparison to the height of the peak on the second-heat curve) and b) the highest point of the exothermic crystal-perfection peak for the crystallite-characterized phase of the nonreversing heat flow plot being above (at a temperature higher than) the Nominal Melting Point, meaning that the dominant portion of crystal rearrangement occurring within the test sample during the DSC scan occurs at temperatures greater than the Nominal Melting Point; this is often a change from the situation revealed in the second-heat plot, where the greatest height of the stated peak is below the Nominal Melting Point; this measurement is made by overlaying the first-heat nonreversing-heat-flow plot on the second-heat total-heat-flows plot and through visual inspection determining the location of the greatest height of the crystal perfection peak for the crystallite-characterized phase with respect to the Nominal Melting Point. FIG. 9 presents three nonreversing plots, A, B, and C for Examples C1, 1, and C6, respectively. Example 1 is a preferred example (having been subjected to a more useful heat treatment temperature as discussed subsequently in more detail), and it is seen (Plot B) that the greatest height of the crystal-perfection peak $T_{CP}$ for this example is above the Nominal Melting Point, which was separately determined as about 160° C.

We have observed the above point for nylon test samples with the proviso that Nominal Melting Point be determined from the first-heat total-heat-flows plot and not the second-heat plot, where hydrogen bonding may have altered the observed melting point.

3. For slow-crystallizing materials such as polyethylene terephthalate a desired morphological refinement is often shown by a combination of highest point of the crystal perfection exothermic peak of the nonreversing heat flow plot being above the Nominal Melting Point (as discussed in Point 2 above), coupled with the presence of a discernible cold-crystallization peak on the nonreversing heat flow plot, meaning that significant crystallizable amorphous molecular material is present in the amorphous-characterized (bonding) phase of the test sample (such material either continuing its presence, e.g., in a more purified form, following a treatment according to the invention and/or being further generated during that treatment).

This characteristic is illustrated in FIG. 10, where Plot A is the first-heat nonreversing-heat-flow plot for a web of the invention (Example 4) and Plot B is the second-heat nonreversing-heat-flow plot for the sample. As seen in Plot A the greatest height of the crystal perfection peak $T_{CP}$ of the nonreversing heat flow curve is above the Nominal Melting Point and there is a discernible cold-crystallization peak $T_{CC}$ on the plot.

These three indications—(1), (2), and (3) above—are referred to herein as Distinguishing DSC Characteristics, and as stated we have so far found that preferred webs of the invention appear to exhibit at least one of these Distinguishing DSC Characteristics. In one aspect, a nonwoven web of the invention can be understood to comprise oriented softenable semicrystalline polymeric fibers that exhibit at least one Distinguishing DSC Characteristic, whereby the fibers may be further bonded or thermomechanically shaped while retaining their fiber structure.

A new method of the invention by which a new web of the invention can be provided comprises, briefly, the steps of 1) providing a nonwoven fibrous web that comprises oriented semicrystalline polymeric fibers, and 2) subjecting the web to a controlled heating and quenching operation that includes a) forcefully passing through the web a fluid heated to a temperature greater than the onset melting temperature of the material of the fiber for a time too short to melt the whole fibers (causing the fibers to lose their discrete fibrous nature; preferably, the time of heating is too short to cause a significant distortion of the fiber cross-section as indicated in the Melting Distortion test described in the working examples later herein), and b) immediately quenching the web by forcefully passing through the web a fluid having sufficient heat capacity to solidify the fibers (i.e., to solidify the amorphous-characterized phase of the fibers softened/melted during heat treatment), which temperature is generally at least 50° C. less than the Nominal Melting Point. Preferably the fluids passed through the web are gaseous streams, and preferably they are air.

"Forcefully" passing a fluid or gaseous stream through a web means that a force in addition to normal room pressure is applied to the fluid to propel the fluid through the web. In a preferred embodiment, step (2) of the described method includes passing the web on a conveyor through a device (which can be termed a quenched flow heater, as discussed subsequently) that provides a focused or knife-like heated gaseous (typically air) stream issuing from the heater under pressure and engaging one side of the web, with gas-withdrawal apparatus on the other side of the web to assist in drawing the heated gas through the web; generally the heated stream extends across the width of the web. The heated stream is in some respects similar to the heated stream from a "through-air bonder" or "hot-air knife," though it may be subjected to special controls that modulate the flow, causing the heated gas to be distributed uniformly and at a controlled rate through the width of the web to thoroughly, uniformly and rapidly heat the fibers of the web to a usefully high temperature.

Forceful quenching immediately follows the heating to rapidly freeze the fibers in a purified morphological form ("immediately" means as part of the same operation, i.e., without an intervening time of storage as occurs when a web is wound into a roll before the next processing step). In a preferred embodiment gas-withdrawal apparatus is positioned downweb from the heated gaseous stream so as to draw a cooling gas or other fluid, e.g., ambient air, through the web promptly after it has been heated and thereby rapidly quench the fibers. The length of heating is controlled, e.g., by the length of the heating region along the path of web travel and by the speed at which the web is moved through the heating region to the cooling region, to cause the intended melting/softening of the amorphous-characterized phase without melting of the whole fiber.

Webs of the invention may be used by themselves, e.g., for filtration media, decorative fabric, or a protective or cover stock. Or they may be used in combination with other webs or structures, e.g., as a support for other fibrous layers deposited or laminated onto the web, as in a multilayer filtration media, or a substrate onto which a membrane may be cast. They may be processed after preparation as by passing them through smooth calendering rolls to form a smooth-surfaced web, or through shaping apparatus to form them into three-dimensional shapes.

OTHER PRIOR ART

Hot-air knives are commonly used for bonding fibrous webs. One example, intended to accomplish a light bonding to prepare a web for further processing is found in Arnold et al., U.S. Pat. No. 5,707,468, which teaches "subjecting a just produced spunbond web to a high flow rate, heated stream of air . . . to very lightly bond the fibers of the web together." The temperature of the heated air is insufficient to melt the polymer in the fiber even at the surface of the fiber, but is only intended to be sufficient to soften the fiber slightly (e.g., see column 5, lines 25-27). The heating operation is only intended to cause the fibers to immediately become very lightly bonded together so that the web has sufficient integrity for further processing. No heating and quenching like that used in the present invention is described.

Thompson et al., U.S. Pat. No. 6,667,254 teaches fibrous nonwoven webs that comprise a mass of polyethylene terephthalate fibers that exhibit a double melting peak on a DSC plot, and the fibers include an amorphous portion, including in exterior portions of the fibers, by which the fibers soften and adhere to achieve interfiber bonding (col. 5, 11. 37-39). But there is no teaching of a web of fibers heated and quenched as in the present invention.

DETAILED DESCRIPTION

Figure 1:
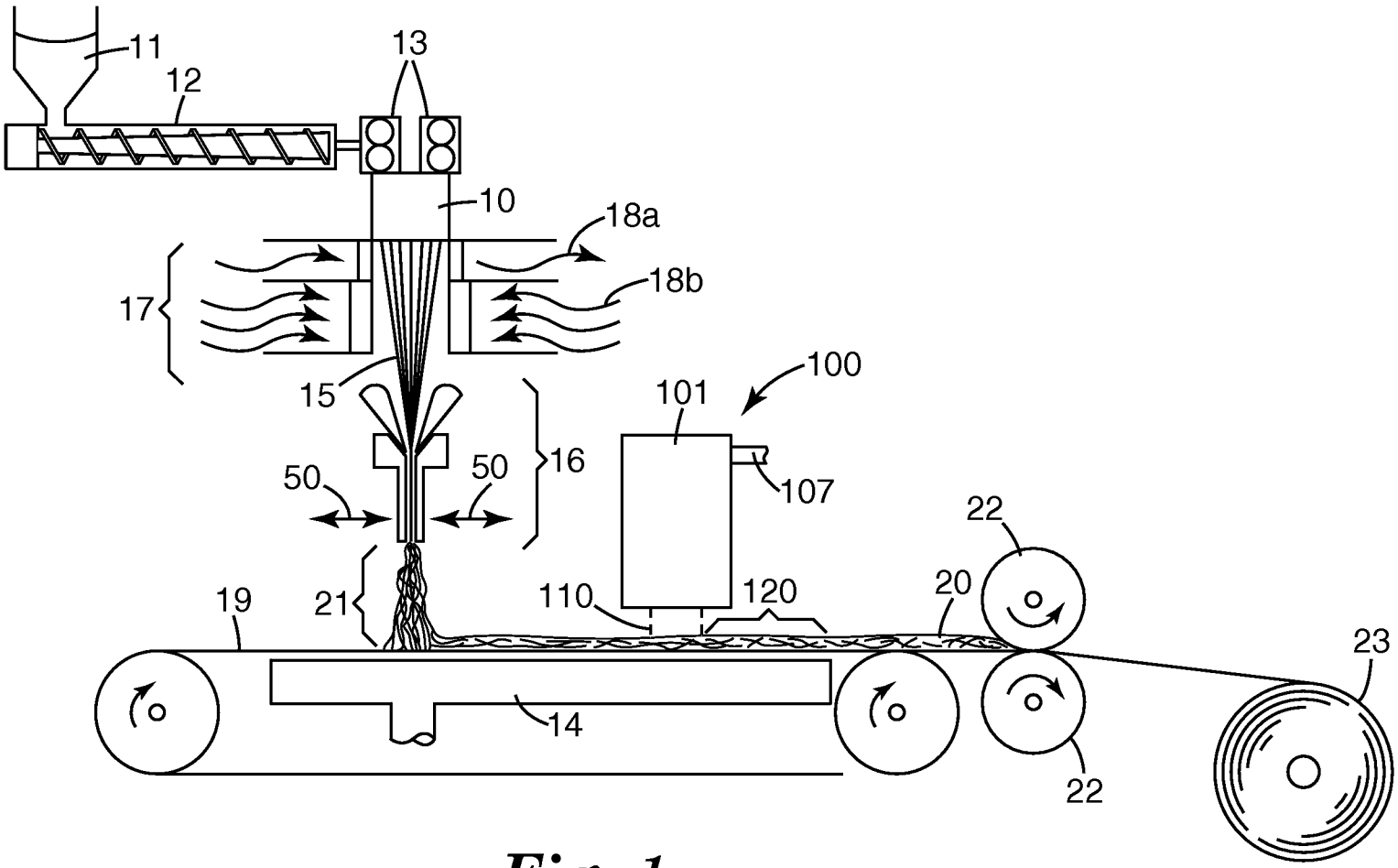
FIG. 1 is a schematic overall diagram of apparatus of the invention for forming a nonwoven fibrous web and heat-treating the web according to the invention.
Figure 2:
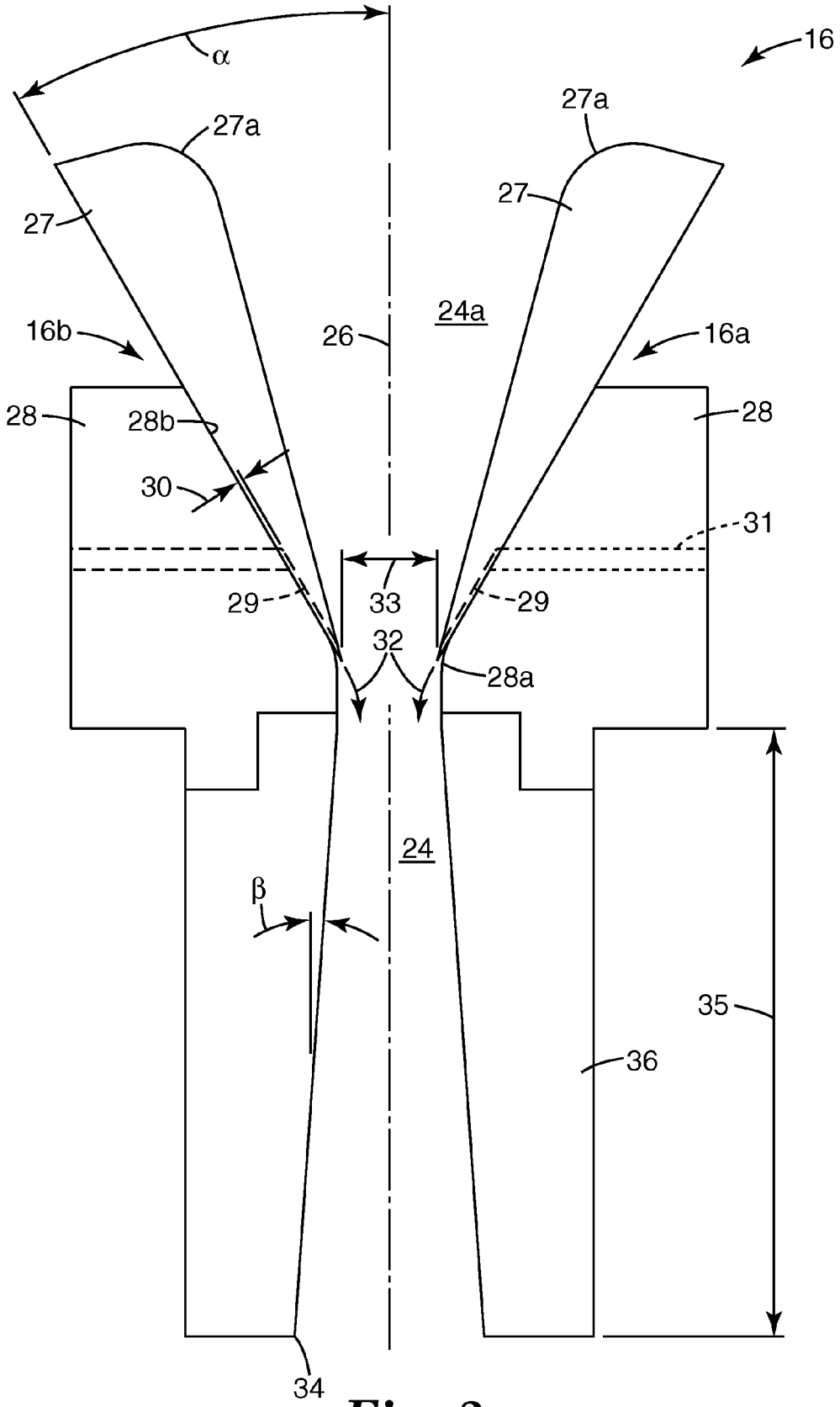
FIG. 2 is an enlarged side view of a processing chamber for preparing fibers useful in a web of the invention, with mounting means for the chamber not shown.
Figure 3:
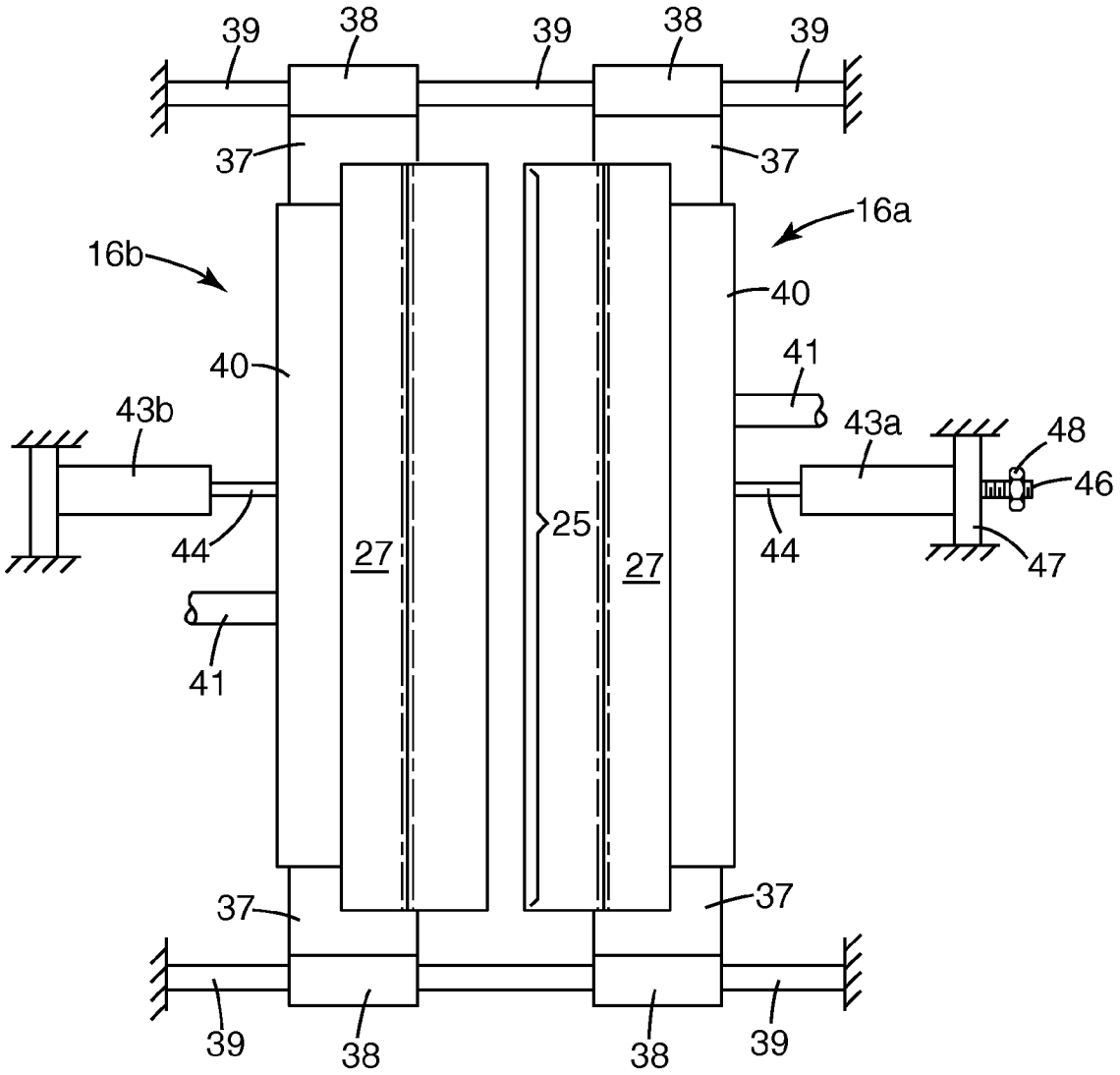
FIG. 3 is a top view, partially schematic, of the processing chamber shown in FIG. 2 together with mounting and other associated apparatus.
Figure 4:
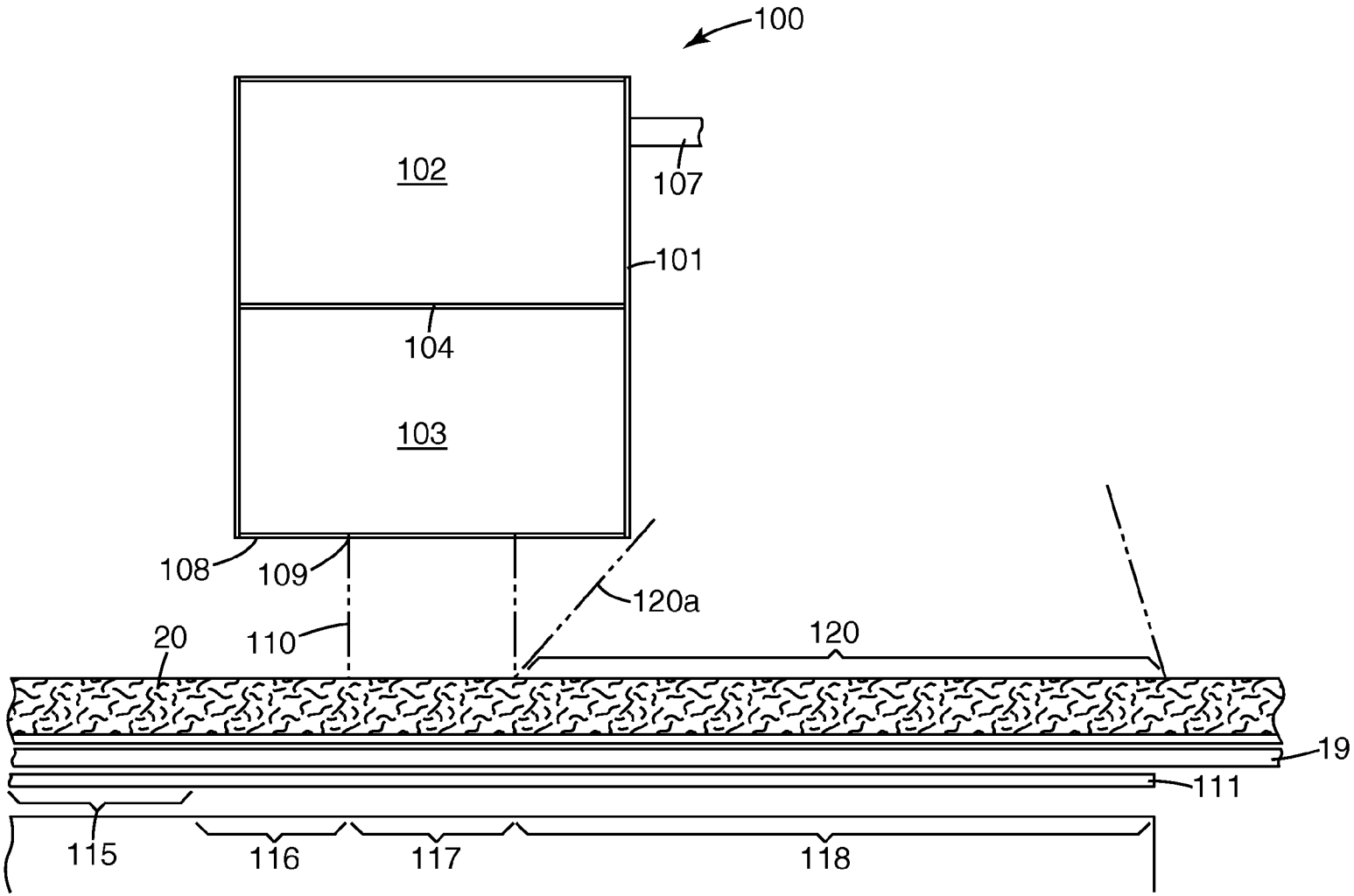
FIG. 4 is a schematic enlarged and expanded view of a heat-treating part of the apparatus shown in FIG. 1.
Figure 5:
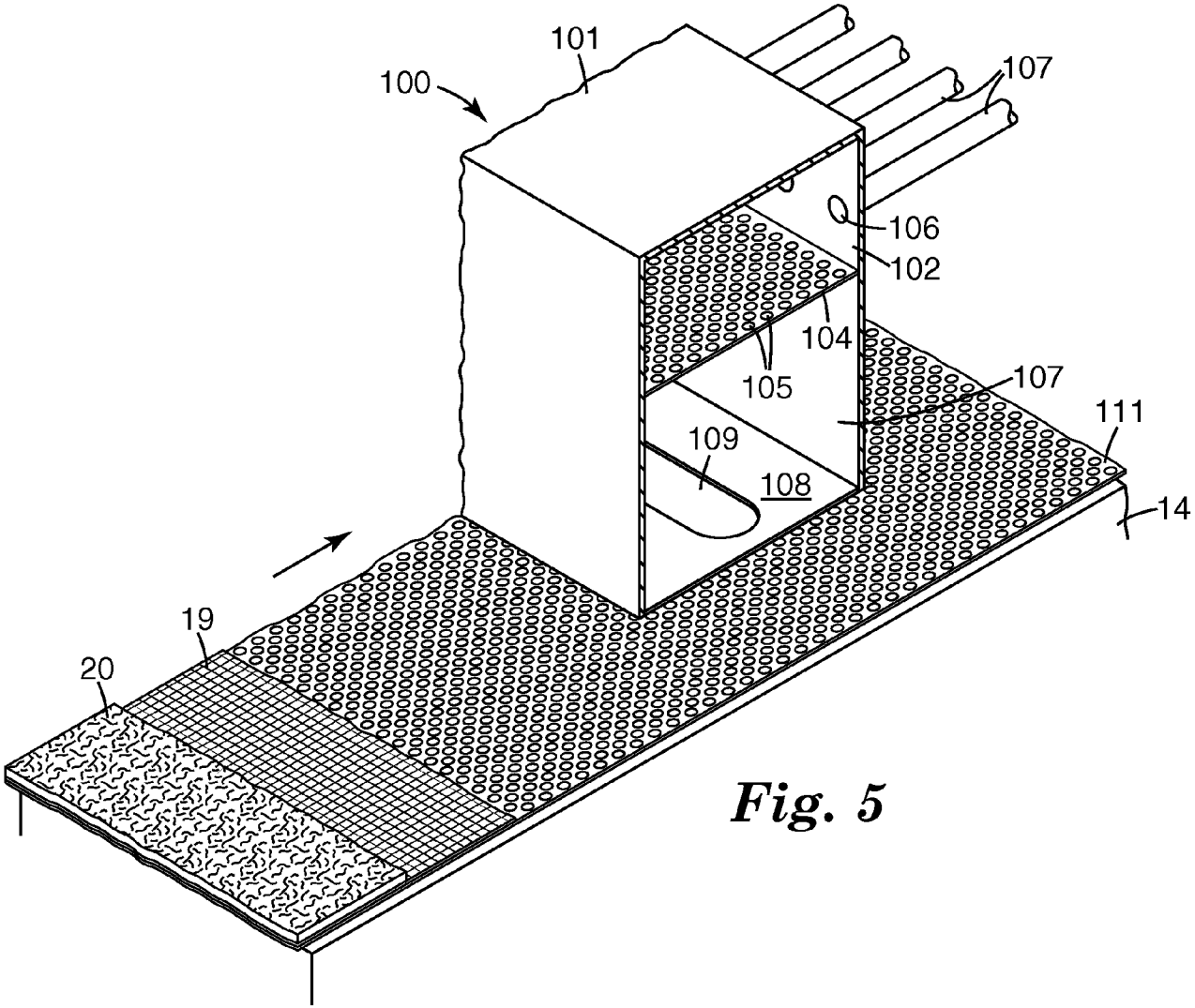
FIG. 5 is a perspective view of the apparatus of FIG. 4.
Figure 6:
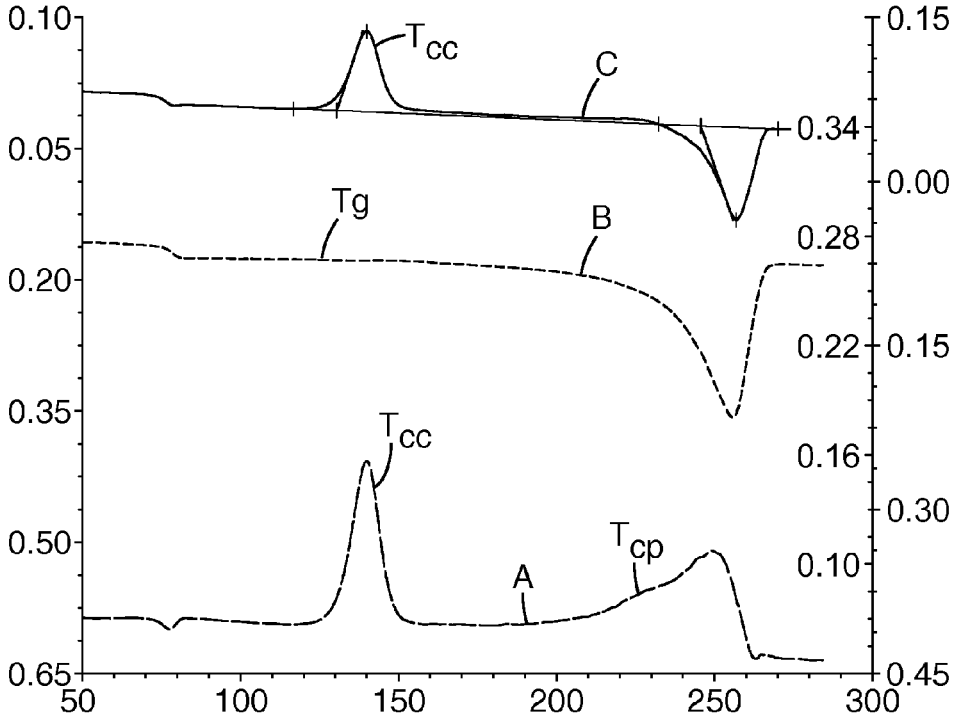
FIGS. 6-15 are plots obtained by differential scanning calorimetry on fibers from various exemplary nonwoven fibrous webs.
Figure 7:
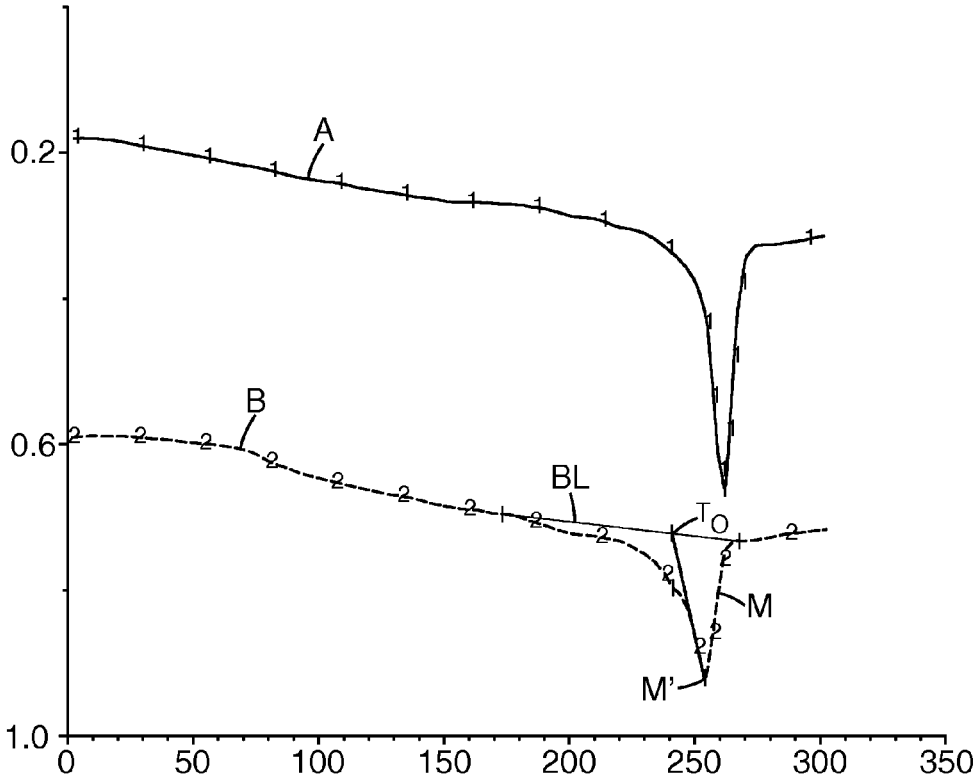
Figure 8:
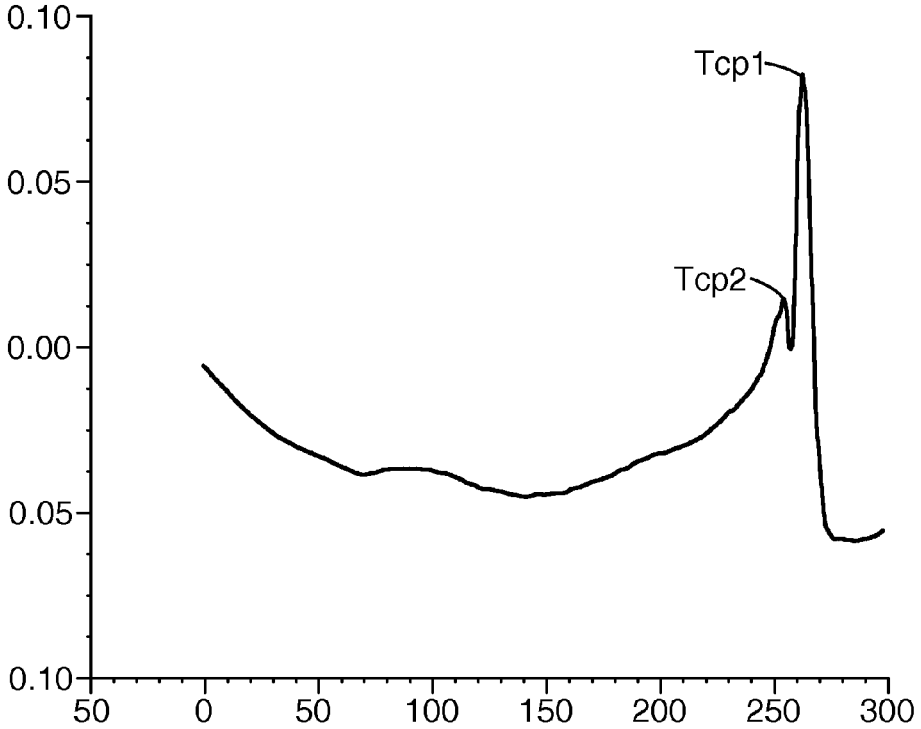

FIGS. 1-5 show an illustrative apparatus for carrying out the invention as part of a direct-web production method and apparatus, in which a fiber-forming polymeric material is converted into a web in one essentially direct operation. FIG. 1 is a schematic overall side view; FIGS. 2 and 3 are enlarged views of fiber-forming portions of the FIG. 1 apparatus; FIG. 4 is an enlarged and expanded side view of a portion of the apparatus shown in FIG. 1 adapted to heat and quench the collected web; and FIG. 5 is a perspective view showing parts of the heating and quenching apparatus and a web being treated, with parts being broken away. The invention can also be practiced by treating preformed webs, in which case apparatus for carrying out the invention might consist essentially only of apparatus as shown in FIGS. 4 and 5.

When practicing the invention in the manner illustrated in FIG. 1, fiber-forming material is brought to an extrusion head 10—in this illustrative apparatus, by introducing a polymeric fiber-forming material into a hopper 11, melting the material in an extruder 12, and pumping the molten material into the extrusion head 10 through a pump 13. Solid polymeric material in pellet or other particulate form is most commonly used and melted to a liquid, pumpable state.

The extrusion head 10 may be a conventional spinnerette or spin pack, generally including multiple orifices arranged in a regular pattern, e.g., straightline rows. Filaments 15 of fiber-forming liquid are extruded from the extrusion head and conveyed to a processing chamber or attenuator 16. The distance 17 the extruded filaments 15 travel before reaching the attenuator 16 can vary, as can the conditions to which they are exposed. Typically, quenching streams of air or other gas 18 are presented to the extruded filaments to reduce the temperature of the extruded filaments 15. Alternatively, the streams of air or other gas may be heated to facilitate drawing of the fibers. There may be one or more streams of air or other fluid—e.g., a first air stream 18*a* blown transversely to the filament stream, which may remove undesired gaseous materials or fumes released during extrusion; and a second quenching air stream 18*b* that achieves a major desired temperature reduction. Depending on the process being used or the form of finished product desired, the quenching air may be sufficient to solidify the extruded filaments 15 before they reach the attenuator 16. In other cases the extruded filaments are still in a softened or molten condition when they enter the attenuator. Alternatively, no quenching streams are used; in such a case ambient air or other fluid between the extrusion head 10 and the attenuator 16 may be a medium for any change in the extruded filaments before they enter the attenuator.

The filaments 15 pass through the attenuator 16, as discussed in more detail below, and then exit onto a collector 19 where they are collected as a mass of fibers 20. The collector 19 is generally porous and a gas-withdrawal device 14 can be positioned below the collector to assist deposition of fibers onto the collector. The distance 21 between the attenuator exit and the collector may be varied to obtain different effects. Also, prior to collection, extruded filaments or fibers may be subjected to a number of additional processing steps not illustrated in FIG. 1, e.g., further drawing, spraying, etc. After collection the collected mass 20 is generally heated and quenched according to the invention; but the mass could be wound into a storage roll for later heating and quenching if desired. Generally, once the mass 20 has been heated and quenched it may be conveyed to other apparatus such as calenders, embossing stations, laminators, cutters and the like; or it may be passed through drive rolls 22 and wound into a storage roll 23.

In a preferred method of carrying out the invention, the mass 20 of fibers is carried by the collector 19 through a heating and quenching operation as illustrated in FIGS. 1, 4 and 5; for shorthand purposes we often refer to the apparatus pictured particularly in FIGS. 4 and 5 as a quenched flow heater, or more simply a quenched heater. The collected mass 20 is first passed under a controlled-heating device 100 mounted above the collector 19. The exemplary heating device 100 comprises a housing 101 that is divided into an upper plenum 102 and a lower plenum 103. The upper and lower plenums are separated by a plate 104 perforated with a series of holes 105 that are typically uniform in size and spacing. A gas, typically air, is fed into the upper plenum 102 through openings 106 from conduits 107, and the plate 104 functions as a flow-distribution means to cause air fed into the upper plenum to be rather uniformly distributed when passed through the plate into the lower plenum 103. Other useful flow-distribution means include fins, baffles, manifolds, air dams, screens or sintered plates, i.e., devices that even the distribution of air.

In the illustrative heating device 100 the bottom wall 108 of the lower plenum 103 is formed with an elongated slot 109 through which an elongated or knife-like stream 110 of heated air from the lower plenum is blown onto the mass 20 traveling on the collector 19 below the heating device 100 (the mass 20 and collector 19 are shown partly broken away in FIG. 5). The gas-exhaust device 14 preferably extends sufficiently to lie under the slot 109 of the heating device 100 (as well as extending downweb a distance 118 beyond the heated stream 110 and through an area marked 120, as will be discussed below). Heated air in the plenum is thus under an internal pressure within the plenum 103, and at the slot 109 it is further under the exhaust vacuum of the gas-exhaust device 14. To further control the exhaust force a perforated plate 111 may be positioned under the collector 19 to impose a kind of back pressure or flow-restriction means that contributes to spreading of the stream 110 of heated air in a desired uniformity over the width or heated area of the collected mass 20. Other useful flow-restriction means include screens or sintered plates.

The number, size and density of openings in the plate 111 may be varied in different areas to achieve desired control. Large amounts of air pass through the fiber-forming apparatus and must be disposed of in the region 115 as the fibers reach the collector. Sufficient air passes through the web and collector in the region 116 to hold the web in place under the various streams of processing air. And sufficient openness is needed in the plate under the heat-treating region 117 and quenching region 118 to allow treating air to pass through the web, while sufficient resistance remains to assure that the air is more evenly distributed.

The amount and temperature of heated air passed through the mass 20 is chosen to lead to an appropriate modification of the morphology of the fibers. Particularly, the amount and temperature are chosen so that the fibers are heated to a) cause melting/softening of significant molecular portions within a cross-section of the fiber, e.g., the amorphous-characterized phase of the fiber as discussed above (this often can be stated, without reference to phases, simply as heating to cause melting of lower-order crystallites within the fiber), but b) not cause complete melting of another significant phase, e.g., the crystallite-characterized phase as discussed above. The fibers as a whole remain unmelted, e.g., the fibers generally retain the same fiber shape and dimensions as they had before treatment. Substantial portions of the crystallite-characterized phase are understood to retain their pre-existing crystal structure after the heat treatment. Crystal structure may have been added to the existing crystal structure; or in the case of highly ordered fibers (see, for example, the highly drawn fibers of Examples 11-14 and C14-20), crystal structure may have been removed to create distinguishable amorphous-characterized and crystallite-characterized phases.

To achieve the intended fiber morphology change throughout the collected mass 20, the temperature-time conditions should be controlled over the whole heated area of the mass. We have obtained best results when the temperature of the stream 110 of heated air passing through the web is within a range of 5° C., and preferably within 2 or even 1° C., across the width of the mass being treated (the temperature of the heated air is often measured for convenient control of the operation at the entry point for the heated air into the housing 101, but it also can be measured adjacent the collected web with thermocouples). In addition, the heating apparatus is operated to maintain a steady temperature in the stream over time, e.g., by rapidly cycling the heater on and off to avoid over- or under-heating. Preferably the temperature is held within one degree Centigrade of the intended temperature when measured at one second intervals.

To further control heating and to complete formation of the desired morphology of the fibers of the collected mass 20, the mass is subjected to quenching immediately after the application of the stream 110 of heated air. Such a quenching can generally be obtained by drawing ambient air over and through the mass 20 as the mass leaves the controlled hot air stream 110. Numeral 120 in FIG. 4 represents an area in which ambient air is drawn by the air-exhaust device through the web. The gas-exhaust device 14 extends along the collector for a distance 118 beyond the heating device 100 to assure thorough cooling and quenching of the whole mass 20 in the area 120. Air can be drawn under the base of the housing 101, e.g., in the area 120*a* marked on FIG. 4 of the drawings, so that it reaches the web directly after the web leaves the hot air stream 110.

An aim of the quenching is to rapidly remove heat from the web and the fibers and thereby limit the extent and nature of crystallization or molecular ordering that will subsequently occur in the fibers. Generally a heating and quenching operation of the invention is performed while a web is moved through the operation on a conveyor, and quenching is performed before the web is wound into a storage roll at the end of the operation. The times of treatment depend on the speed at which a web is moved through an operation, but generally the total heating and quenching operation is performed in a minute or less, and preferably in less than 15 seconds. By rapid quenching from the molten/softened state to a solidified state, the amorphous-characterized phase is understood to be frozen into a more purified crystalline form, with reduced molecular material that can interfere with softening, or repeatable softening, of the fibers. Desirably the mass is cooled by a gas at a temperature at least 50° C. less than the Nominal Melting Point; also the quenching gas is desirably applied for a time on the order of at least one second. In any event the quenching gas or other fluid has sufficient heat capacity to rapidly solidify the fibers.

Other fluids that may be used include water sprayed onto the fibers, e.g., heated water or steam to heat the fibers, and relatively cold water to quench the fibers.

As discussed above, success in achieving the desired heat treatment and morphology of the amorphous-characterized phase often can be confirmed with DSC testing of representative fibers from a treated web; and treatment conditions can be adjusted according to information learned from the DSC testing.

FIG. 2 is an enlarged side view of a representative device 16 for orienting the fibers that are collected as a web or matte and then treated according to the invention. The illustrative orienting or processing device 16, often called herein an attenuator, comprises two movable halves or sides 16*a* and 16*b* separated so as to define between them the processing chamber 24: the facing surfaces of the sides 16*a* and 16*b* form the walls of the chamber. FIG. 3 is a top and somewhat schematic view at a different scale showing the representative attenuator 16 and some of its mounting and support structure. As seen from the top view in FIG. 3, the processing or attenuation chamber 24 is generally an elongated slot, having a transverse length 25 (transverse to the path of travel of filaments through the attenuator), which can vary depending on the number of filaments being processed.

Although existing as two halves or sides, the attenuator functions as one unitary device and will be first discussed in its combined form. (The structure shown in FIGS. 2 and 3 is representative only, and a variety of different constructions may be used.) The representative attenuator 16 includes slanted entry walls 27, which define an entrance space or throat 24*a* of the attenuation chamber 24. The entry walls 27 preferably are curved at the entry edge or surface 27*a* to smooth the entry of air streams carrying the extruded filaments 15. The walls 27 are attached to a main body portion 28, and may be provided with a recessed area 29 to establish a gap 30 between the body portion 28 and wall 27. Air may be introduced into the gaps 30 through conduits 31, creating air knives (represented by the arrows 32) that increase the velocity of the filaments traveling through the attenuator, and that also have a further quenching effect on the filaments. The attenuator body 28 is preferably curved at 28*a* to smooth the passage of air from the air knife 32 into the passage 24. The angle ($\alpha$) of the surface 28*b* of the attenuator body can be selected to determine the desired angle at which the air knife impacts a stream of filaments passing through the attenuator. Instead of being near the entry to the chamber, the air knives may be disposed further within the chamber.

The attenuation chamber 24 may have a uniform gap width (the horizontal distance 33 on the page of FIG. 2 between the two attenuator sides is herein called the gap width) over its longitudinal length through the attenuator (the dimension along a longitudinal axis 26 through the attenuation chamber is called the axial length). Alternatively, as illustrated in FIG. 2, the gap width may vary along the length of the attenuator chamber. Preferably, the attenuation chamber is narrower internally within the attenuator; e.g., as shown in FIG. 2, the gap width 33 at the location of the air knives is the narrowest width, and the attenuation chamber expands in width along its length toward the exit opening 34, e.g., at an angle $\beta$ Such a narrowing internally within the attenuation chamber 24, followed by a broadening, creates a venturi effect that increases the volume of air inducted into the chamber and adds to the velocity of filaments traveling through the chamber. In a different embodiment, the attenuation chamber is defined by straight or flat walls; in such embodiments the spacing between the walls may be constant over their length, or alternatively the walls may slightly diverge (preferred) or converge over the axial length of the attenuation chamber. In all these cases, the walls defining the attenuation chamber are regarded as parallel herein, because the deviation from exact parallelism is relatively slight. As illustrated in FIG. 2, the walls defining the main portion of the longitudinal length of the passage 24 may take the form of plates 36 that are separate from, and attached to, the main body portion 28.

The length of the attenuation chamber 24 can be varied to achieve different effects; variation is especially useful with the portion between the air knives 32 and the exit opening 34, sometimes called herein the chute length 35. The angle between the chamber walls and the axis 26 may be wider near the exit 34 to change the distribution of fibers onto the collector; or structure such as deflector surfaces, Coanda curved surfaces, and uneven wall lengths may be used at the exit to achieve a desired spreading or other distribution of fibers. In general, the gap width, chute length, attenuation chamber shape, etc. are chosen in conjunction with the material being processed and the mode of treatment desired to achieve desired effects. For example, longer chute lengths may be useful to increase the crystallinity of prepared fibers. Conditions are chosen and can be widely varied to process the extruded filaments into a desired fiber form.

As illustrated in FIG. 3, the two sides 16*a* and 16*b* of the representative attenuator 16 are each supported through mounting blocks 37 attached to linear bearings 38 that slide on rods 39. The bearing 38 has a low-friction travel on the rod through means such as axially extending rows of ball-bearings disposed radially around the rod, whereby the sides 16*a* and 16*b* can readily move toward and away from one another. The mounting blocks 37 are attached to the attenuator body 28 and a housing 40 through which air from a supply pipe 41 is distributed to the conduits 31 and air knives 32.

In this illustrative embodiment, air cylinders 43*a* and 43*b* are connected, respectively, to the attenuator sides 16*a* and 16*b* through connecting rods 44 and apply a clamping force pressing the attenuator sides 16*a* and 16*b* toward one another. The clamping force is chosen in conjunction with the other operating parameters so as to balance the pressure existing within the attenuation chamber 24. In other words, the clamping force and the force acting internally within the attenuation chamber to press the attenuator sides apart as a result of the gaseous pressure within the attenuator are in balance or equilibrium under preferred operating conditions. Filamentary material can be extruded, passed through the attenuator and collected as finished fibers while the attenuator parts remain in their established equilibrium or steady-state position and the attenuation chamber or passage 24 remains at its established equilibrium or steady-state gap width.

During operation of the representative apparatus illustrated in FIGS. 1-3, movement of the attenuator sides or chamber walls generally occurs only when there is a perturbation of the system. Such a perturbation may occur when a filament being processed breaks or tangles with another filament or fiber. Such breaks or tangles are often accompanied by an increase in pressure within the attenuation chamber 24, e.g., because the forward end of the filament coming from the extrusion head or the tangle is enlarged and creates a localized blockage of the chamber 24. The increased pressure is sufficient to force the attenuator sides or chamber walls 16*a* and 16*b* to move away from one another. Upon this movement of the chamber walls the end of the incoming filament or the tangle can pass through the attenuator, whereupon the pressure in the attenuation chamber 24 returns to its steady-state value before the perturbation, and the clamping pressure exerted by the air cylinders 43 returns the attenuator sides to their steady-state position. Other perturbations causing an increase in pressure in the attenuation chamber include "drips," i.e., globular liquid pieces of fiber-forming material falling from the exit of the extrusion head upon interruption of an extruded filament, or accumulations of extruded filamentary material that may engage and stick to the walls of the attenuation chamber or to previously deposited fiber-forming material.

As will be seen, in the preferred embodiment of processing chamber illustrated in FIGS. 2 and 3, there are no side walls at the ends of the transverse length of the chamber. The result is that fibers passing through the chamber can spread outwardly outside the chamber as they approach the exit of the chamber. Such a spreading can be desirable to widen the mass of fibers collected on the collector.

Further details of the attenuator and possible variations are disclosed in Berrigan et al., U.S. Pat. Nos. 6,607,624 and 6,916,752, which are incorporated herein by reference.

Although the apparatus shown in FIGS. 1-3 with movable walls has advantages as described, use of such an attenuator is not necessary to practice of the present invention. Fibers useful in the invention may be prepared on apparatus in which the walls of the attenuator are fixed and unmovable, or do not move in practice.

In addition, the invention may be practiced on webs prepared by procedures completely different from the direct-web preparation techniques illustrated in FIG. 1. For example, heating and quenching operations of the invention can be performed on separately prepared webs such as webs of air-laid staple fibers or preformed spunbond webs. Essentially any nonwoven fibrous web comprising oriented semicrystalline fibers may be treated according to the invention. As just an example, webs prepared by such known techniques as those described in U.S. Pat. Nos. 3,692,618; 4,340,563; and 4,820,459 may be treated.

Also, apparatus for heating and quenching as described or claimed in this patent specification (which to our knowledge is a novel apparatus) has other uses in addition to those described herein. For example, the apparatus can be used to obtain bonded webs without interest or intention to cause morphological refinement or to subject the treated web to subsequent operations making use of such refinement. One example of such a use is taught in a patent application being filed the same day as the present patent application, Ser. No. 11/461,192, which is incorporated herein by reference. That patent application describes a nonwoven fibrous web comprising a matrix of continuous meltspun fibers and separately prepared microfibers dispersed among the meltspun fibers; the web can be treated with apparatus of the present patent application to cause bonding of the meltspun fibers to form a coherent or self-sustaining matrix; such a treated web may or may not be subjected to subsequent operations that take advantage of morphological refinement of the meltspun fibers.

Generally, any semicrystalline fiber-forming polymeric material may be used in preparing fibers and webs of the invention, including the polymers commonly used in commercial fiber formation such as polyethylene, polypropylene, polyethylene terephthalate, nylon, and urethanes. The specific polymers listed here are examples only, and a wide variety of other polymeric or fiber-forming materials are useful.

Fibers also may be formed from blends of materials, including materials into which certain additives have been added, such as pigments or dyes. Bicomponent fibers, such as core-sheath or side-by-side bicomponent fibers, may be used ("bicomponent" herein includes fibers with two or more components, each occupying a separate part of the cross-section of the fiber and extending over the length of the fiber). However, the invention is most advantageous with monocomponent fibers, which have many benefits (e.g., less complexity in manufacture and composition; "monocomponent" fibers have essentially the same composition across their cross-section; monocomponent includes blends or additive-containing materials, in which a continuous phase of uniform composition extends across the cross-section and over the length of the fiber) and can be conveniently bonded and given added bondability and shapeability by the invention. Different fiber-forming materials may be extruded through different orifices of the extrusion head so as to prepare webs that comprise a mixture of fibers. In other embodiments of the invention other materials are introduced into a stream of fibers prepared according to the invention before or as the fibers are collected so as to prepare a blended web. For example, other staple fibers may be blended in the manner taught in U.S. Pat. No. 4,118,531; or particulate material may be introduced and captured within the web in the manner taught in U.S. Pat. No. 3,971,373; or microwebs as taught in U.S. Pat. No. 4,813,948 may be blended into the webs. Alternatively, fibers prepared by the present invention may be introduced into a stream of other fibers to prepare a blend of fibers.

Various processes conventionally used as adjuncts to fiber-forming processes may be used in connection with filaments as they enter or exit from the attenuator, such as spraying of finishes or other materials onto the filaments, application of an electrostatic charge to the filaments, application of water mists, etc. In addition, various materials may be added to a collected web, including bonding agents, adhesives, finishes, and other webs or films.

The fibers prepared by a method of the invention may range widely in diameter. Microfiber sizes (about 10 micrometers or less in diameter) may be obtained and offer several benefits; but fibers of larger diameter can also be prepared and are useful for certain applications; often the fibers are 20 micrometers or less in diameter. Fibers of circular cross-section are most often prepared, but other cross-sectional shapes may also be used. Depending on the operating parameters chosen, e.g., degree of solidification from the molten state before entering the attenuator, the collected fibers may be rather continuous or essentially discontinuous. The orientation of the polymer chains in the fibers can be influenced by selection of operating parameters, such as degree of solidification of filament entering the attenuator, velocity and temperature of air stream introduced into the attenuator by the air knives, and axial length, gap width and shape (because, for example, shape influences the venturi effect) of the attenuator passage.

Transmission electron micrographs through a section of fibers of the invention have revealed that in at least many cases, the amorphous-characterized phase in a fiber of the invention takes the form of a multitude of minute phases distributed throughout the cross-section of the fiber. Wherever their location however, at least portions of the amorphous-dominated phase appear to be at or near the exterior of the fibers, because of their participation in bonding of the fibers.

Immediately after the heating and quenching operation a web of the invention generally has a degree of bonding sufficient for the web to be handled, e.g., removed from the collection screen and wound into a storage roll. But as discussed above, additional bonding is possible and is often performed, e.g., to more permanently stabilize the web, or to shape it, including providing it with a nonplanar shape or smoothing its surfaces.

Any additional bonding is most typically done in a through-air-bonder, but also can be done in an oven or as part of a calendering or shaping operation. (Although there is seldom any reason to do so, bonding can also be accomplished or assisted by use of extraneous bonding materials included in the web during formation or applied after web-formation.) During thermal bonding of a web of the invention heat is generally applied in a narrow range, precisely selected to cause softening of the amorphous-characterized phase of a fiber to achieve bonding, while leaving the crystallite-characterized phase substantially unaffected. The unaffected crystallite-characterized phase thus can have a reinforcing function, e.g., it can function to retain fiber shape during the bonding operation, so that aside from bond regions the fiber retains its discrete fibrous form and the web retains its basic fibrous structure. In autogenous bonding operations the fiber can retain its fiber cross-section over its length outside bond regions, where there typically is some flow and coalescence of material from adjacent bonded fibers.

Another important advantage of the invention is the ability to shape a web of the invention. By shaping it is meant reconfiguring the web into a persistent new configuration, i.e., a self-sustaining configuration that the web will generally retain during use. In some cases shaping means smoothing one or both surfaces of the web and in some cases compacting the web. In other cases shaping involves configuring the web into a nonplanar shape such as perhaps a cup-shape for use in a face mask. Again the fibrous character of the web is retained during shaping, though the fibers may receive a somewhat different cross-section through the pressure of the shaping operation.

Besides improved bondability and shapability, fibers of the invention can provide other useful properties and features. For example, the improved morphological purity of the fibers as found in the amorphous-characterized phase may make the fibers chemically more reactive, enhancing use of the fiber for such purposes as grafting substrates. The fact that a web of the invention can be bonded without addition of an extraneous material is another important advantage, enhancing utility of the webs as membrane supports, electrochemical cell separators, filtration media, etc.

The invention is further illustrated in the following illustrative examples. Several examples are identified as comparative examples, because they do not show certain properties (such as softening, bonding, or DSC characteristics) desired for bondability, moldability, etc.; but the comparative examples may be useful for other purposes and may exhibit novel and nonobvious character.

EXAMPLES 1-6

Apparatus as shown in FIGS. 1-5 was used to prepare fibrous webs from polypropylene and polyethylene terephthalate. Examples 1-3 and C1-C6 were prepared from polypropylene (PP) having a Nominal Melting Point of 160.5° C. and a melt flow index (MFI) of 70 (Dypro 3860x polypropylene resin supplied by Total Chemical of Houston, Tex.). Examples 4-6 and C7-C8 were prepared from polyethylene terephthalate (PET) having a Nominal Melting Point of 254.1° C. and an intrinsic viscosity of 0.61 (3M Polyester Resin 65100).

Certain parts of the apparatus and operating conditions are summarized in Table 1. The clamping pressure reported in the table was sufficient that the walls of the attenuator remained generally fixed during preparation of fibers. Apparatus parameters not reported in the table are as follows. The plate 104 in FIG. 5 contained ¼-inch-diameter (0.64 centimeter) holes at a uniform spacing of ⅜ inch (0.95 centimeter) such as to constitute 40% of the plate area. The collector 19 was a 50-inch-wide (1.27 meter), 40-mesh stainless steel woven belt in a chevron pattern with 0.43 mm by 0.60 mm openings (Style 2055 from Albany International Engineered Fabrics of Portland Tenn.). Fibers were deposited on the collector belt to form a mass 20 having a width of about 22 inches (55.9 centimeters). Section 115 of the plate 111 underlying the belt 19 had a machine-direction length of 14.5 inches (36.8 centimeters) and contained 1.59-milliimeter-diameter holes on centers spaced 2.78 millimeters at a uniform spacing such as to constitute 30% of the plate area; section 116 had a length of 23.5 inches (about 60 centimeters) and contained 1.59-millimeter-diameter holes on centers spaced 3.18 millimeters at a uniform spacing such as to constitute 23% of the plate area; and sections 117 and 118 together had a length of about 9 inches (about 23 centimeters) and contained 3.97-millimeter-diameter holes at a uniform spacing with centers spaced 4.76 millimeters such that the holes constituted 63% of the plate area; the machine-direction length of section 117 is the slot width in Table 1, 3.8 centimeters, leaving the length 118 of the quenching section as about 19.2 centimeters. The air-exhaust duct 14 had a width (transverse to the machine direction, which is the direction of movement of the collector belt) of 22 inches (55.9 centimeters) and a length sufficient for the distance 118 in FIG. 4 to be about 19 centimeters.

The heating face velocity reported in the table was measured at the center of the slot 109 at a point about one-half inch (1.27 centimeter) above the mass using a hot-wire anemometer; 10 measurements were taken over the width of the zone and arithmetically averaged. The cooling face velocity was measured in the same manner at the center (along the machine-direction axis) of the area 120 in FIG. 4. The temperatures reported in Table 1 for the heating zones 1-6 are temperatures of air entering the box 101 from the conduits 107. There were six conduits 107 and temperature of input air was measured at the entry point to the box 101 by open-junction thermocouples.

Various measurements and tests were performed on representative webs of the examples. Differential scanning calorimetry was performed using a Modulated DSC™ system (Model Q1000 supplied by TA Instruments Inc, New Castle, Del.). Test samples of about 2-4 milligrams were cut from a test web with a razor blade and tested using conditions as follows: For the set of Examples 1-3 and Comparative Examples 1-6 the sample was heated from −90 to 210° C. at a heating rate of 5° C./minute, a perturbation amplitude of plus-or-minus 0.796° C. and a period of 60 seconds. For the set of Examples 4-6 and Comparative Examples C7-8 the sample was heated from −10 to 310° C. at a heating rate of 4° C./minute, a perturbation amplitude of plus-or-minus 0.636° C. and a period of 60 seconds. A heat-cool-heat test cycle was used for all materials.

Figure 9:
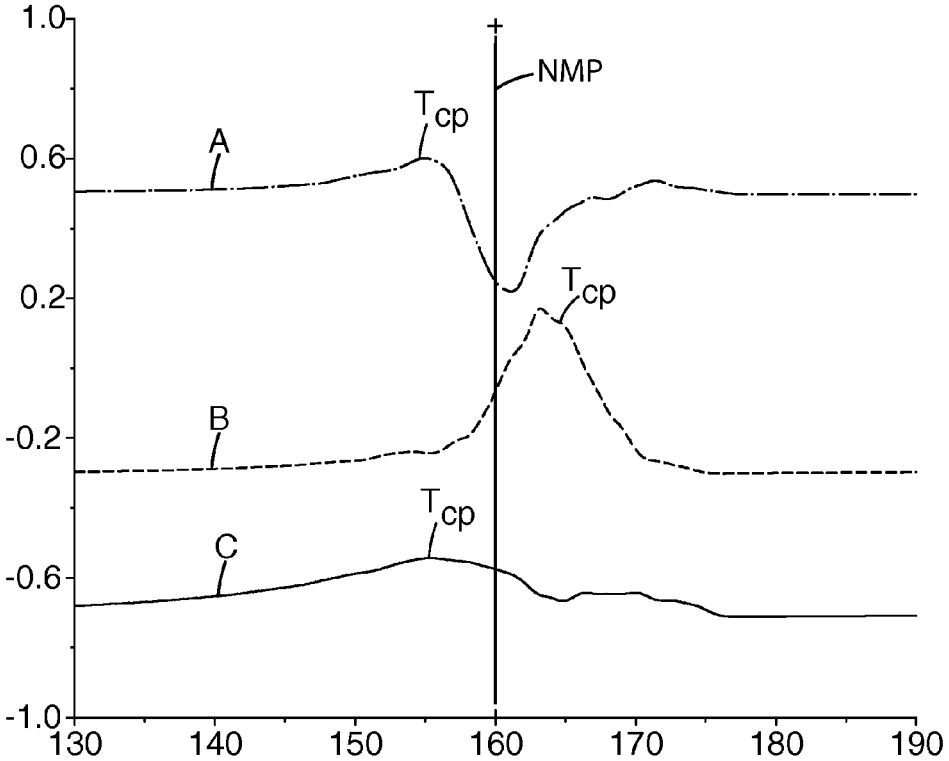

FIG. 9 shows three nonreversing heat flow plots obtained for the webs of Examples C1, 1 and C6, each web having been subjected to heat treatment at a different temperature—Example C1, about 151° C. (Plot A), Example 1, about 154° C. (Plot B), and Example C6, about 166° C. (Plot C). Example C1 was treated at a temperature too low to accomplish a desired morphological refinement according to the invention, and Plot A shows that because there is a significant crystal-perfection peak $T_{CP}$ having its greatest magnitude at a temperature lower than the Nominal Melting Point. Example 1 was treated at an effective temperature, and Plot B shows that the greatest magnitude of the crystal-perfection peak is above the Nominal Melting Point. Example C6 was treated at too high a temperature to accomplish a desired morphological reduction (note that a significant crystal-perfection peak has been regenerated at a temperature lower than the Nominal Melting Point; in other words, the heat treatment has caused such a substantial "melting" of the fibers as to regenerate lower-order or imperfect crystal structure (by comparison, such crystal structure was reduced in the Example 1 web by the appropriate heat treatment at 154° C.).

Figure 10:
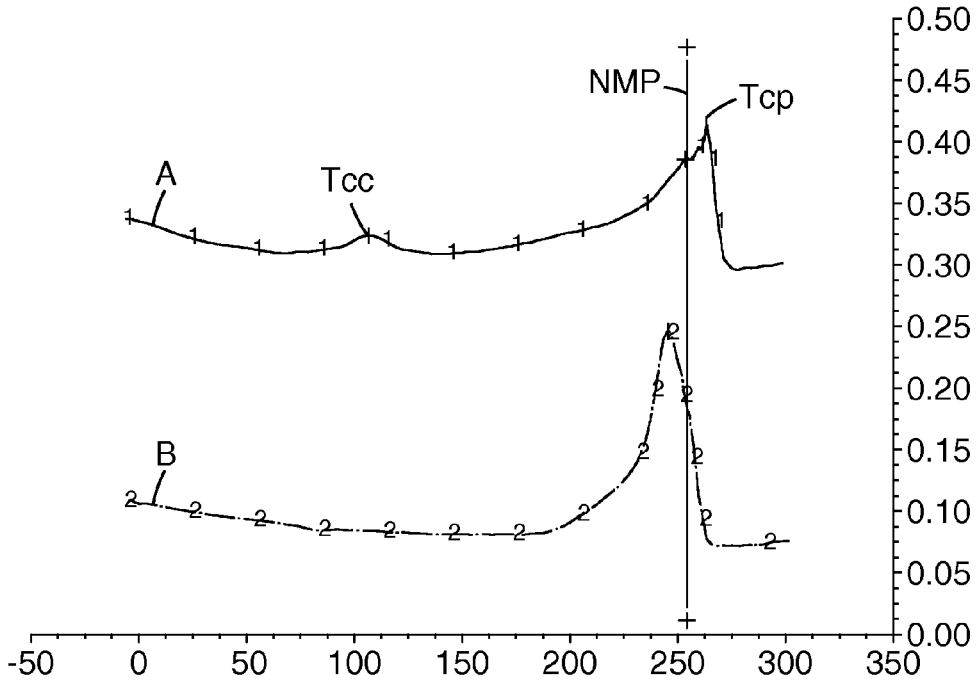

FIG. 10 presents the first-heat (Plot A) and second-heat (Plot B) nonreversing-heat-flow plots for Example 4.

Table 1 also presents data gathered from FIGS. 9 and 10 as to the temperature difference (in ° C.) between the crystal-perfection peaks for the crystallite-characterized phase ($T_{CP1}$) and amorphous-characterized phase ($T_{CP2}$). The treated webs were also studied in a Melting Distortion test conducted by examining the webs under an optical microscope (magnification of about 50 times). Surface fibers not at fiber intersections were examined for any distortion from a circular cross-section. If upon examining a minimum sample size of twenty fibers, it was found that the fibers had been distorted so that on average the fibers exhibited a transverse dimension more than 20% greater than the diameter of a circular cross-section, the web was considered to have undergone excessive heating during treatment. Significant diameter distortion is regarded as an indication of whole-fiber melting, i.e., that the whole fiber including crystallite-characterized regions has undergone melting and not just the intended melting/softening of the amorphous-characterized regions. Results are reported in Table 1.

The molding capabilities of the webs of Examples 4 and C8 were examined by molding representative samples into a respirator-shaped cup shape using conventional molding conditions but different mold temperatures shown in Table 2 below. Two samples of each example were molded using a five-second molding cycle. The mold height was 5.7 centimeters and formed a generally oval shape with a minor axis of 11.5 centimeters and 13 major axis. There was a 0.5-centimeter gap between mold sections. The height of the molded cup was measured by clamping it to a table top, placing a flat blade on top of the molded cup, and measuring the distance from the table top to the knife blade. A 100-gram weight was then laid on the blade and the height measured again. Table 2 reports the mold temperatures and the height measurements.

TABLE I

| | | Example No. | | | | | | |
|---|---|---|---|---|---|---|---|---|
| | | C1 | C2 | 1 | 2 | C3 | C4 | C5 |
| Polymer | | PP | PP | PP | PP | PP | PP | PP |
| MFI/IV | | 70 | 70 | 70 | 70 | 70 | 70 | 70 |
| Melt Temp | (° C.) | 235 | 235 | 235 | 235 | 235 | 235 | 235 |
| Polymer Flow Rate | (g/orifice/min) | 0.6 | 0.6 | 0.2 | 0.2 | 0.2 | 0.2 | 0.2 |
| Die to Attenuator | (cm) | 84 | 84 | 84 | 84 | 84 | 84 | 84 |
| Attenuator to collection | (cm) | 56 | 56 | 68 | 68 | 68 | 68 | 68 |
| Attenuator gap (top) | (mm) | 5.055 | 5.055 | 5.08 | 5.08 | 5.08 | 5.08 | 5.08 |
| Attenuator gap (bottom) | (mm) | 4.394 | 4.394 | 4.724 | 4.724 | 4.724 | 4.724 | 4.724 |
| Clamping Pressure | newtons | 600 | 600 | 420 | 420 | 420 | 420 | 420 |
| Attenuator air volume | ACMM | 8.8 | 8.8 | 7.8 | 7.8 | 7.8 | 7.8 | 7.8 |
| Attenuator air temp | ° C. | Room temperature (average 21.6° C.) | | | | | | |
| Collector speed | m/minute | 7 | 7 | 2.4 | 2.3 | 2.4 | 2.3 | 2.3 |
| Average fiber diameter | micrometer | 15.9 | 15.7 | 9.9 | 9.8 | 9.9 | 9.9 | 10.0 |
| Basis weight | $g/m^2$ | 116 | 115 | 123 | 124 | 126 | 125 | 121 |
| Thickness or loft (bulk density) | mm | 0.7 | 1.3 | 1.5 | 1.3 | 1.5 | 1.0 | 1.6 |
| QFH to collector | cm | 1.9 | 1.9 | 1.9 | 1.9 | 1.9 | 1.9 | 1.9 |
| Slot width | cm | 3.8 | 3.8 | 3.8 | 3.8 | 3.8 | 3.8 | 3.8 |
| Slot length | cm | 55.9 | 55.9 | 55.9 | 55.9 | 55.9 | 55.9 | 55.9 |
| Heating face velocity | m/min | 1670 | 1600 | 2580 | 2610 | 2540 | 2630 | 2540 |
| QFH temp zone 1 | ° C. | 150.7 | 134.9 | 153.6 | 159.7 | 150.9 | 162.5 | 147.8 |
| Zone 2 | ° C. | 151.4 | 135.0 | 153.9 | 159.5 | 150.8 | 163.1 | 147.6 |
| Zone 3 | ° C. | 151.4 | 135.1 | 153.8 | 160.1 | 151.1 | 163.2 | 147.9 |
| Zone 4 | ° C. | 151.3 | 135.0 | 153.7 | 160.0 | 151.0 | 162.8 | 148.0 |
| Zone 5 | ° C. | 151.1 | 134.9 | 153.3 | 160.0 | 150.9 | 162.7 | 147.8 |
| Zone 6 | ° C. | 151.2 | 134.7 | 154.1 | 160.0 | 151.1 | 162.7 | 147.9 |
| Air exhaust length | cm | 20.3 | 20.3 | 20.3 | 20.3 | 20.3 | 20.3 | 20.3 |
| Air exhaust vacuum | mm $H_2O$ | 200 | 200 | 280 | 280 | 280 | 280 | 280 |
| Cooling face vel'ity | m/min | 290 | 290 | 500 | 500 | 500 | 500 | 500 |
| $T_{CP1}$ minus $T_{CP2}$ | ° C. | N/A | N/A | 9.7 | 8.3 | 0 | 0 | 0 |

TABLE I-continued

| Melting Distortion | | N | N | N | N | N | Y* | N |
|---|---|---|---|---|---|---|---|---|
| | | Example No. | | | | | | |
| | | C6 | 3 | C7 | 4 | 5 | 6 | C8 |
| Polymer | | PP | PP | PET | PET | PET | PET | PET |
| MFI/IV | | 70 | 70 | 0.61 | 0.61 | 0.61 | 0.61 | 0.61 |
| Melt Temp | (° C.) | 235 | 235 | 285 | 285 | 285 | 285 | 285 |
| Polymer Flow Rate | (g/orifice/min) | 0.2 | 0.2 | 0.5 | 0.5 | 0.5 | 0.5 | 0.5 |
| Die to Attenuator | (cm) | 84 | 84 | 70 | 70 | 70 | 70 | 70 |
| Attenuator to collection | (cm) | 68 | 68 | 57 | 57 | 57 | 57 | 57 |
| Attenuator gap (top) | (mm) | 5.08 | 5.08 | 4.902 | 4.902 | 4.902 | 4.902 | 4.902 |
| Attenuator gap (bottom) | (mm) | 4.724 | 4.724 | 4.521 | 4.521 | 4.521 | 4.521 | 4.521 |
| Clamping Pressure | newtons | 420 | 420 | 4.1 | 4.1 | 4.1 | 4.1 | 4.1 |
| Attenuator air volume | ACMM | 7.8 | 7.8 | 9.3 | 9.3 | 9.3 | 9.3 | 9.3 |
| Attenuator air temp | ° C. | Room temperature (average 21.6° C.) | | 26 | 26 | 26 | 26 | 26 |
| Collector speed | m/minute | 2.4 | 2.5 | 8.4 | 8.4 | 8.4 | 8.4 | 8.4 |
| Average fiber diameter | micrometer | 10.1 | 9.8 | 12.6 | 12.2 | 12 | 12.4 | 12.3 |
| Basis weight | $g/m^2$ | 118 | 124 | 110 | 100 | 100 | 120 | 115 |
| Thickness or loft (bulk density) | mm | 0.71 | 1.3 | 0.9 | 0.8 | 0.8 | 1 | 1.1 |
| QFH to collector | cm | 1.9 | 1.9 | 1.9 | 1.9 | 1.9 | 1.9 | 1.9 |
| Slot width | cm | 3.8 | 3.8 | 3.8 | 3.8 | 3.8 | 3.8 | 3.8 |
| Slot length | cm | 55.9 | 55.9 | 55.9 | 55.9 | 55.9 | 55.9 | 55.9 |
| Heating face velocity | m/min | 2660 | 2600 | 2700 | 2675 | 2675 | 2675 | 2700 |
| QFH temp zone 1 | ° C. | 167.5 | 156.7 | 275.0 | 269.8 | 259.0 | 250.0 | 240 |
| Zone 2 | ° C. | 166.1 | 156.9 | 274.8 | 270.4 | 260.3 | 250.3 | 239.8 |
| Zone 3 | ° C. | 166.1 | 156.8 | 275.3 | 269.9 | 260.3 | 250.3 | 239.9 |
| Zone 4 | ° C. | 165.8 | 156.9 | 275.8 | 269.9 | 260.0 | 249.9 | 240.0 |
| Zone 5 | ° C. | 166.1 | 156.8 | 275.1 | 269.7 | 260.1 | 250.0 | 240.0 |
| Zone 6 | ° C. | 165.9 | 156.9 | 274.8 | 270.3 | 260.0 | 250.1 | 240.1 |
| Air exhaust length | cm | 20.3 | 20.3 | 20.3 | 20.3 | 20.3 | 20.3 | |
| Air exhaust vacuum | mm $H_2O$ | 280 | 280 | 280 | 280 | 280 | 280 | |
| Cooling face vel'ity | m/min | 500 | 500 | 530 | 530 | 530 | 530 | |
| $T_{CP1}$ minus $T_{CP2}$ | ° C. | 0 | 9.5 | 13.9 | 8.5 | 8.5 | 9.9 | 0 |
| Melting Distortion | | Y | N | N | N | N | N | Y |

*top surface only

TABLE 2

| Example No. | Mold Temperature (° C.) | Height (uncompressed) (cm) | Height (compressed) (cm) |
|---|---|---|---|
| 4(1) | 155 | 5 | 4.75 |
| 4(2) | 155 | 5.75 | 5 |
| C8(1) | 155 | 3.25 | 0.3 |
| C8(2) | 155 | 3.5 | 0.3 |
| 4(1) | 165 | 5.75 | 5.4 |
| 4(2) | 165 | 5.75 | 5 |
| C8(1 | 165 | 3.8 | 0.6 |
| C8(2) | 165 | 4.5 | 0.6 |
| 4(1) | 175 | 5.75 | 5.5 |
| 4(2) | 175 | 5.75 | 5.4 |
| C8(1 | 175 | 3.8 | 0.3 |
| C8(2) | 175 | 3.2 | 0.3 |
| 4(1) | 205 | 4.75 | 4.75 |
| 4(2) | 205 | 4.75 | 4.75 |
| C8(1 | 205 | 2.5 | 0.3 |
| C8(2) | 205 | 3.5 | 0.3 |

As will be noted, the webs of Example 1 replicated well the mold shape even when molded at a temperature of 155° C., less than the Nominal Melting Point of the webs. All the molded Example 1 webs except one of those molded at 155° C. and the two molded at 205° C. were essentially at mold height and the others were at least 87% or 83%, respectively, of mold height. (For purposes herein replication is regarded as attaining at least 75% of mold dimensions.) It is also noted that the molded Example 1 webs held their shape well under pressure, while the C8 molded webs essentially collapsed under pressure.

EXAMPLES 7-8

The webs of Examples 7 and 8 and C9-C11 were prepared by carding oriented crimped nylon 6-6 staple fibers on a Holingsworth random card; the fibers, supplied by Rhodia Technical Fibers, Gerliswilstrasse 19 CH-6021 Emmenbrucke, Germany, were characterized as 2-inch (about 5 centimeter) cut staple 6-denier (16.7 decitex) fiber having a crimp count of three per inch (1.2 per centimeter). Unbonded webs of 100 gsm basis weight were prepared and passed on a conveyor through a quenched flow heater as pictured in FIGS. 4 and 5 and generally as described in Examples 1-6 with further conditions as described in Table 3 below and as follows: heated air was delivered at 1050 meters per minute; the web was quenched by 25° C. ambient air drawn through the web at a rate of about 400 meters per minute over a length along the conveyor of 15 centimeters.

Figure 11:
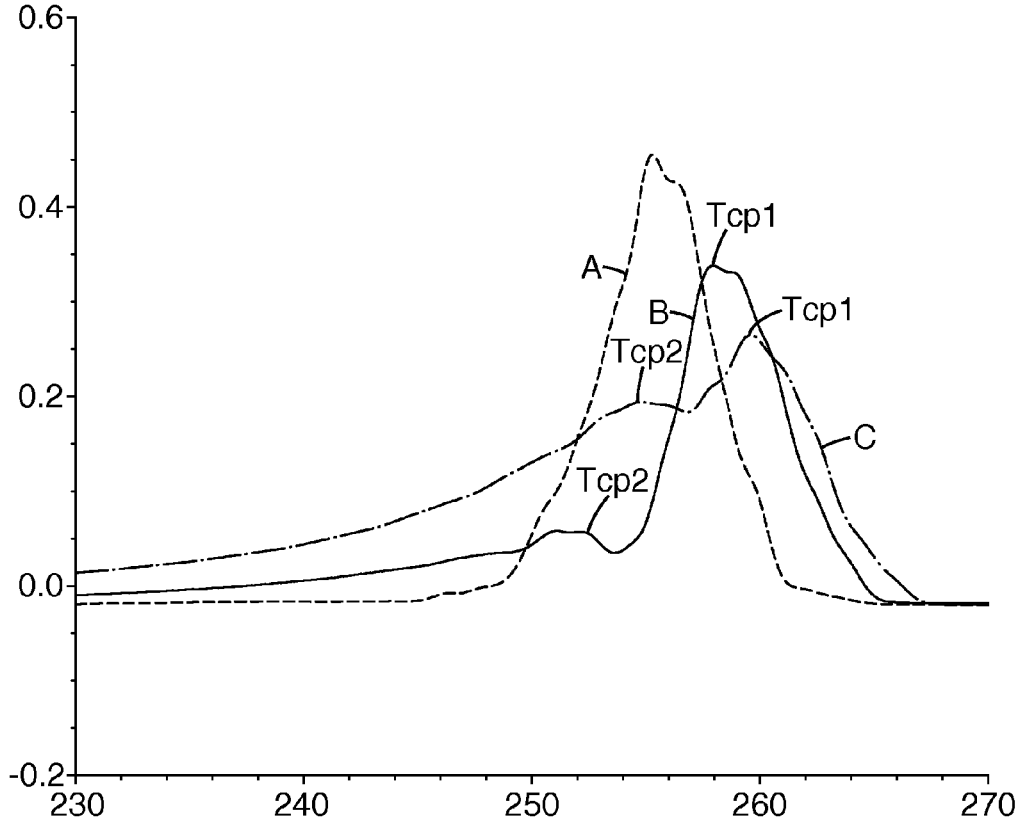

The treated webs were studied in the described Melting Distortion test, and samples of the webs were also subjected to MDSCT testing the sample was heated from −25 to 300° C. at a heating rate of 4° C./minute, a perturbation amplitude of plus-or-minus 0.636° C. and a period of 60 seconds. Nonreversing-heat-flow plots for Examples C9 (Plot A), 9 (Plot B), and 10 (Plot C) are shown in FIG. 11.

TABLE 3

| Example No. | Treatment Temperature (° C.) | Speed (m/min) | Slot Width (cm) | Melting observed | Web bonded | $T_{CP1}$-$T_{CP2}$ |
|---|---|---|---|---|---|---|
| C9 | 245 | 4.6 | 3.81 | N | N | 1.4 |
| 7 | 255 | 4.6 | 3.81 | N | Y | 8.8 |
| 8 | 257 | 13.7 | 3.81 | N | Y | 8.1 |
| 9 | 260 | 13.7 | 3.81 | N | Y | 7.0 |
| C11 | 260 | 13.7 | 0.64 | Y | Y | 1.7 |
| C12 | 260 | 4.6 | 3.81 | Y | Y | 0 |

TABLE 3-continued

| Example No. | Treatment Temperature (° C.) | Speed (m/min) | Slot Width (cm) | Melting observed | Web bonded | $T_{CP1}$-$T_{CP2}$ |
|---|---|---|---|---|---|---|
| 10 | 265 | 13.7 | 0.64 | Y* | Y | 7.6 |
| C13 | 265 | 4.6 | 3.81 | Y | Y | 5.0 |

*top surface only

Although Example 10 showed some melting on the top surface, fibers deeper within the web were not melted, and these webs were thus regarded as meeting the desired performance characteristics; it is not clear to us why Example C11 did not demonstrate similar effects.

EXAMPLES 11-14

A commercial polypropylene spunbond web (BBA Spunbond Typar style 3141N, available from BBA Fiberweb Americas Industrial Division, Old Hickory, Tenn.) having a nominal basis weight of 50 gsm and comprising oriented polypropylene fibers having an average diameter of 40 micrometers was treated by passing it through a quenched flow heater apparatus as illustrated by the apparatus 100 in FIGS. 1, 4 and 5. The web was passed through the apparatus at a rate of 4.6 meters per minute. Air heated to a temperature as given in Table 4 was passed through the slot 109, which was 3.8 centimeters wide and 56 centimeters long, at a rate of 420 meters per minute. The gas-withdrawal device 14 applied a negative pressure of 215 mm $H_2O$ below the web. The plates 104 and 111 were as described for Examples 1-6. Ambient air (at a temperature of about 25 degrees C.) was drawn through the web at a rate of 360 meters per minute through a distance 120 of 15 centimeters.

The treated webs were studied in the described Melting Distortion test, and were also subjected to a Rebonding test in which two five-inch-long (12.7-centimeter-long) pieces of a treated web are overlaid on one another and heated and pressed in a calendering operation. The pieces are overlaid with their top surfaces (the top of the web as it went through the quenched flow heater) facing one another and with a 5-centimeter-long overlap. The overlaid pieces were passed through calender rolls having a surface temperature of 80 degrees C. at a rate of 3.9 meters per minute and with a nip pressure of 3.9 kilograms force per centimeter. After calendering, the opposite ends of the webs were grasped and one end was twisted 180 degrees. Bonded webs showed no sign of separation when viewed under a microscope.

Figure 12:
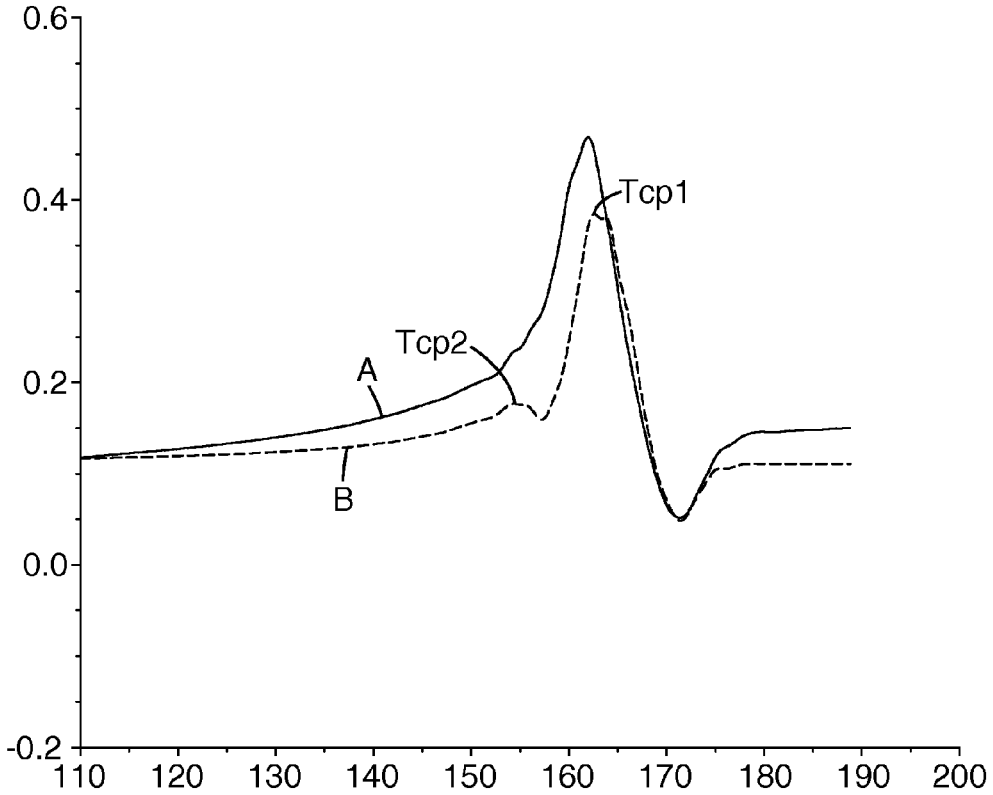
Figure 13:
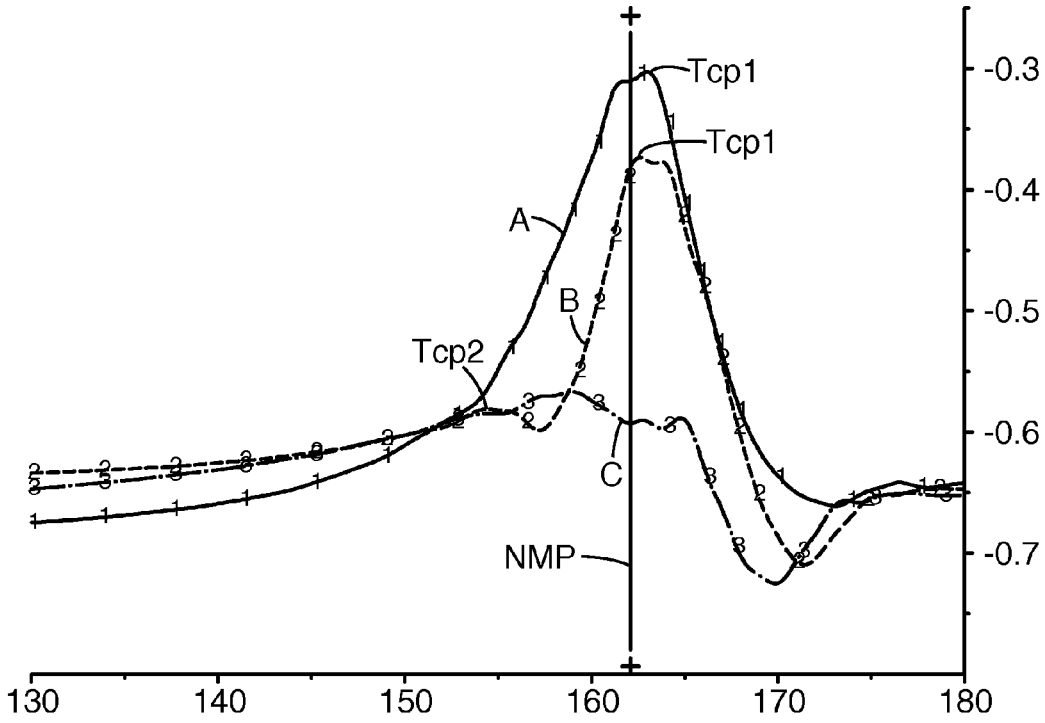

Results of the Melting Distortion and Rebonding tests are reported in Table 4. MDSC™ testing (Model TA 2920 MDSC™ machine) was also conducted on the treated samples. Two-to-three-milligram samples were heated from −50 to 210° C. at a heating rate of 5° C./minute, a perturbation amplitude of plus-or-minus 0.796° C. and a period of 60 seconds. Results are reported in FIGS. 12 and 13. FIG. 12 shows the first-heat nonreversing heat flow plots for Examples C20 (Plot A) and 14 (Plot B). Plot A reveals that the fibers of the untreated commercial web are highly crystalline, with little if any amorphous-characterized, or bonding, phase. Plot B shows that after treatment according to the invention a significant bonding phase ($T_{CP2}$) has been generated and the holding-phase peak maximum ($T_{CP1}$) has moved to temperature greater than the Nominal Melting Point. FIG. 13 also presents first-heat nonreversing heat flow plots, where Plot A is for Example C15, Plot B is for Example 14, and Plot C is for Example C19. FIG. 13 reveals that the heating temperature for Comparative Example C14 was too low for useful refinement; treatment in Example 14 produced distinctive and useful bonding and holding phases; and the treatment for Comparative Example C19 was too hot and melted the holding phase.

From the testing and examination of webs Examples C14-C19 were regarded as lacking in a desired level of softening and bonding properties.

TABLE 4

| Example No. | Heated Air Temperature (° C.) | Melting Distortion Test | Rebonding Test | $T_{CP1}$-$T_{CP2}$ |
|---|---|---|---|---|
| C14 | 145 | N | N | 0 |
| C15 | 147 | N | N | 0 |
| C16 | 150 | N | N | 0 |
| 11 | 153 | N | Y | 6.5 |
| 12 | 155 | N | Y | 8.6 |
| 13 | 157 | N | Y | 8.2 |
| 14 | 160 | N | Y | 8.2 |
| C17 | 162 | N | Y | 9.0 |
| C18 | 163 | Y | N | 5.4 |
| C19 | 165 | Y | N | 5.1 |
| C20 | No Treatment | N | N | 0 |

EXAMPLES 15-17

A nonwoven fibrous web was prepared from oriented polypropylene 4-denier, 4.76-centimeter crimped staple fibers (Kosa T196 White 060 Staple Fibers, available from Fiber Visions Inc., Covington, Ga.) using a Hergeth Random card. An unbonded web having a basis weight of 100 grams per square centimeter was prepared. Samples of the web were then treated with a quenched flow heater apparatus 100 as shown in FIGS. 4 and 5. The samples were passed through the treatment apparatus at a rate of 4.6 meters per second. Air heated to a temperature as given in Table 5 was passed through the slot 109, which was 3.8 centimeters wide and 56 centimeters long, at a rate of 420 meters per minute. The gas-withdrawal device 14 applied a negative pressure of 215 mm $H_2O$ below the web. The plates 104 and 111 were as described for Examples 1-6. Ambient air (at a temperature of about 25 plus-or-minus 2 degrees C.) was drawn through the web at a rate of 360 meters per minute through a distance 120 of 15 centimeters.

Figure 14:
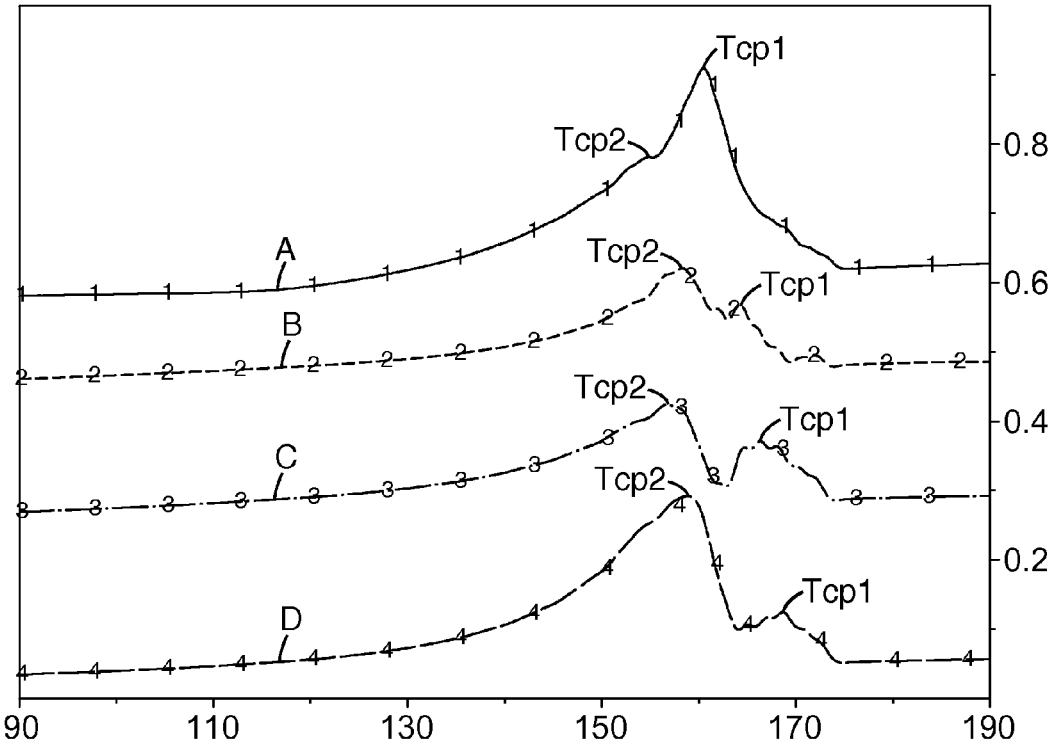

The Melting Distortion and Rebonding tests were performed on the treated samples, and the results are reported in Table 5. MDSC™ testing (using the Model 2920 machine) was also conducted on the treated samples. Two-to-three-milligram samples were heated from −50 to 210° C. at a heating rate of 5° C./minute, a perturbation amplitude of plus-or-minus 0.796° C. and a period of 60 seconds. First-heat nonreversing heat flow plots obtained are reported in FIG. 14, where Plot A is for Example C21, Plot B is for Example 15, Plot C is for Example 16, and Plot D is for Example C24. Plot A illustrates that the commercial fibers used in preparing webs of the invention were highly crystalline with too little bonding phase for useful bonding; and further shows that the heating temperature in Example C21 was too low to cause useful refinement. Plots B and C show that the treatment for Examples 15 and 16 developed a useful bonding and holding phase. Plot D shows that the treatment for Comparative Example C24 was too hot and melted the holding phase.

TABLE 5

| Example No. | Heated Air Temperature (° C.) | Melting Distortion Test | Rebonding Test | $T_{CP1}$-$T_{CP2}$ |
|---|---|---|---|---|
| C21 | 145 | N | N | 0 |
| C22 | 147 | N | N | 0 |
| 15 | 150 | N | Y | 6.0 |
| 16 | 153 | N | Y | 9.6 |
| 17 | 155 | N | Y | 10.4 |
| C23 | 157 | Y | N | 8.1 |
| C24 | 160 | Y | N | 9.8 |
| C25 | No Treatment | N | N | 0 |

EXAMPLES 18-20

Unbonded nonwoven fibrous webs weighing 100 grams per square meter were prepared on a Rando Webber from oriented polyethylene terephthalate 4.7-decitex by 2-inch-long (about 5 cm) crimped staple fibers (Kosa T224 fibers from Fiber Visions Incorporated Covington, Ga.). The webs were passed under a quenched flow heater as shown in FIGS. 4 and 5 at speeds reported in Table 6. Heated air was delivered through a slot 109 at 1050 meters per minute at the temperatures reported in Table 6; the slot width is also reported in Table 6. The web was quenched by ambient air (about 25° C.) drawn through the web at 400 meters/minute; the distance 120 was 15 cm.

Figure 15:
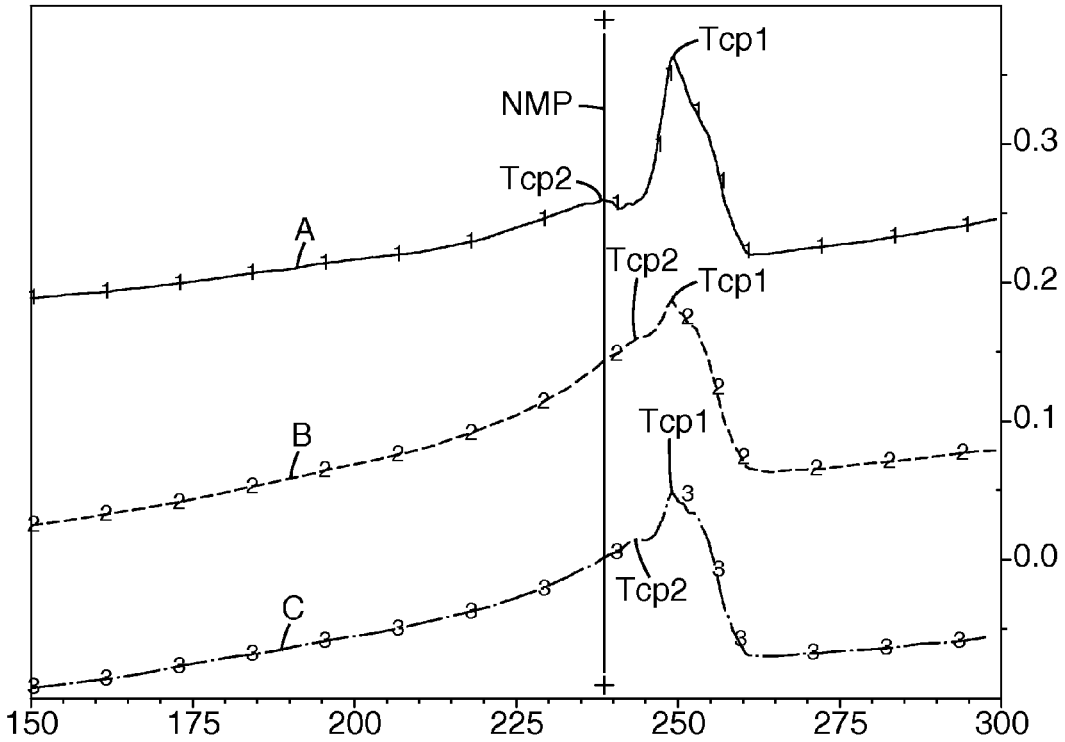

For MDSC™ testing (using the Model Q1000 machine), two-to-three-milligram samples were heated from −10 to 310° C. at a heating rate of 4° C./minute, a perturbation amplitude of plus-or-minus 0.636° C. and a period of 60 seconds. The resulting first-heat nonreversing heat flow plots are shown in FIG. 15, where Plot A is for Example C25, Plot B is for Example 19, and Plot C is for Example C27. Plot A illustrates that the commercial fibers used in preparing webs of the invention were highly crystalline with too little bonding phase for useful bonding; and further shows that the heating temperature in Example C25 was too low to cause useful refinement. Plot B shows that the treatment for Example 19 developed a useful bonding and holding phase. Plot C shows that the treatment for Comparative Example C27 was too hot and melted the holding phase.

The webs were checked for fiber melting in the Melting Distortion test and for bonding in the Rebonding test. Results are reported in Table 6.

TABLE 6

| Sample | Treatment Temperature (degrees C.) | Speed (m/min) | Slot Width (cm) | Melting Observed | Bonded Web | $T_{CP1}$-$T_{CP2}$ |
|---|---|---|---|---|---|---|
| C25 | 240 | 4.6 | 3.81 | N | N | 16.5 |
| 18 | 255 | 4.6 | 3.81 | N | Y | 9.2 |
| C26 | 255 | 13.7 | .64 | N | N | 14.8 |
| 19 | 255 | 13.7 | 3.81 | N | Y | 9.7 |
| C27 | 260 | 4.6 | 3.81 | Y | Y | 8.9 |
| 20 | 260 | 13.7 | 0.64 | Y* | Y | 13.3 |
| C28 | 260 | 4.6 | 3.81 | Y | Y | 11.0 |

*Top surface only

The molding test of Examples 1-6 was also conducted on webs of Example C25 and Example 19. The molding temperature was 172° C. and the mold dimensions and molding conditions were the same as for Examples 1-6. Results, shown in Table 7, demonstrate that the molding operation for Example 19 was successful, a remarkable effect given the fact that the 172° C. molding temperature was about 65° C. less than the Nominal Melting Point of the fibers (238.6° C.).

TABLE 7

| Example No. | Mold Temperature (° C.) | Height (uncompressed) (cm) | Height (compressed) (cm) |
|---|---|---|---|
| C25(1) | 172 | 2.7 | 0.3 |
| C25(2) | 172 | 2.2 | 0.2 |
| 19(1) | 172 | 4.8 | 4.4 |
| 19(2) | 172 | 4.8 | 4.8 |

What is claimed is:

1. A method for making a bonded nonwoven fibrous web comprising:

1) providing a nonwoven fibrous web that comprises oriented monocomponent fibers selected from the group consisting of nylon fibers, polypropylene fibers, polyethylene fibers, and polyethylene terephthalate fibers, the fibers exhibiting a Differential Scanning Calorimetry (DSC) scan having an exothermic crystal-perfection peak in a non-reversing heat flow plot, and a basic melting point appearing as a single endothermic peak in a total heat flow plot, and further exhibiting a Nominal Melting Point as defined herein with the proviso that for nylon fibers the Nominal Melting Point be determined from a first-heat total-heat-flow plot, further wherein the crystal-perfection peak shows:
   a) a first discernible crystal perfection peak in the non-reversing heat flow plot corresponding to an amorphous-characterized phase that exhibits repeatable softening, and
   b) a second discernible crystal perfection peak in the non-reversing heat flow plot corresponding to a crystallite-characterized phase that reinforces the fiber structure during softening of the amorphous-characterized phase,
   wherein the highest point of the crystal perfection exothermic peak is positioned at a temperature as high or higher than the Nominal Melting Point, whereby the fibers may be autogenously bonded while retaining orientation and fiber structure, and
2) subjecting the web to a controlled heating and quenching operation that includes:
   a) forcefully passing through the web a fluid heated to at least the onset melting temperature of said polymeric material for a time sufficient to melt lower-order crystallites in the fibers but too short to wholly melt the fibers, and
   b) immediately quenching the web by forcefully passing through the web a fluid at a temperature at least 50° C. less than the Nominal Melting Point.

2. A method of claim 1 in which the nonwoven web is moved on a conveyor through the heating and quenching operation.

3. A method of claim 2 in which the web moves through the heating and quenching operation in one minute or less.

4. A method of claim 1 in which the heated fluid is a heated gaseous stream applied to the web under pressure to forcefully move the heated gaseous stream through the web.

5. A method of claim 4 in which the pressure that forcefully moves the heated gaseous stream through the web is supplied at least in part by gas-withdrawal apparatus positioned below the web in alignment with the heated gaseous stream.

6. A method of claim 4 in which flow-distribution means is interposed in the path of the heated gaseous stream before the stream reaches the web to spread the stream over the web.

7. A method of claim 4 in which flow-restricting means is interposed in the path of the heated gaseous stream at a point after the heated gaseous stream has passed through the web.

8. A method of claim 7 in which the flow-restricting means comprises a perforated plate.

9. A method of claim 4 in which the temperature of the heated gaseous stream is maintained within a range of one degree C. across the width of the web.

10. A method of claim 4 in which the gaseous stream is heated by a heater rapidly cycled on and off to maintain the temperature of the heated gaseous stream within one degree Centigrade of a selected treatment temperature.

11. A method of claim 1 in which the quenching fluid passed through the web in step 2(b) is a gaseous stream applied to the web under pressure to forcefully move the gaseous stream through the web.

12. A method of claim 11 in which the quenching gaseous stream is at ambient temperature.

13. A method of claim 11 in which in which the pressure that forcefully moves the quenching gaseous stream through the web is supplied at least in part by gas-withdrawal apparatus positioned below the web in alignment with the quenching gaseous stream.

14. A method of claim 13 in which flow-restricting means is interposed in the path of the quenching gaseous stream at a point after the quenching gaseous stream has passed through the web.

15. A method of claim 1 wherein the fluid is heated to at least the Nominal Melting Point of said polymeric material.

16. A method of claim 1 including the further step (3) of autogenously bonding the fibers with heat after completion of the controlled heating and quenching operation.

17. A method of claim 1 including the further step (3) of shaping the web after completion of the controlled heating and quenching operation by heating the web to a bonding temperature and pressing it into the desired shape.

18. A method of preparing a bonded nonwoven fibrous web comprising the steps of:

1) providing a precursor fibrous web by:
   a) extruding molten fiber-forming semicrystalline polymeric material through a die to form filaments,
   b) drawing the filaments in a processing chamber to form oriented monocomponent fibers selected from the group consisting of nylon fibers, polypropylene fibers, polyethylene fibers, and polyethylene terephthalate fibers, and
   c) collecting the oriented fibers on a collector to form the nonwoven precursor fibrous web, and thereafter
2) subjecting the precursor fibrous web to a controlled heating and quenching operation whereby the filaments may be autogenously bonded while retaining orientation and filament structure, wherein the fibers, after the controlled heating and quenching operation, exhibit a Differential Scanning calorimetry (DSC) scan having an exothermic crystal-perfection peak in a non-reversing heat flow plot and a basic melting point appearing as a single endothermic peak in a total heat flow plot, and further exhibiting a Nominal Melting Point as defined herein with the proviso that for nylon fibers the Nominal Melting Point be determined from a first-heat total-heat-flow plot, further wherein the crystal-perfection peak shows:

i) a first discernible crystal perfection peak in the non-reversing heat flow plot corresponding to an amorphous-characterized phase that exhibits repeatable softening, and ii) a second discernible crystal perfection peak in the non-reversing heat flow plot corresponding to a crystallite-characterized phase that reinforces the fiber structure during softening of the amorphous-characterized phase, wherein the highest point of the crystal perfection exothermic peak is positioned at a temperature as high or higher than the Nominal Melting Point, whereby the fibers may be autogenously bonded while retaining orientation and fiber structure, additionally wherein the controlled heating and quenching operation is comprised of:

a) forcefully passing through the web a gaseous stream heated to at least the onset melting temperature of said polymeric material for a time sufficient to melt lower-order crystallites in the fibers but too short to wholly melt the fibers, and b) immediately quenching the web by forcefully passing through the web a fluid at a temperature at least 50° C. less than the Nominal Melting Point.

19. A method of claim 18 in which the nonwoven web is moved on a conveyor through the controlled heating and quenching operation.

20. A method of claim 18 in which the web moves through the heating and quenching operation in 15 seconds or less.

21. A method of claim 18 in which the pressure that forcefully moves the heated gaseous stream through the web is supplied at least in part by gas-withdrawal apparatus positioned below the web in alignment with the heated gaseous stream.

22. A method of claim 18 in which flow-distribution means is interposed in the path of the heated gaseous stream before the stream reaches the web to spread the stream over the web.

23. A method of claim 18 in which flow-restricting means is interposed in the path of the heated gaseous stream at a point after the heated gaseous stream has passed through the web.

24. A method of claim 18 wherein the gaseous stream is heated to at least the Nominal Melting Point of said polymeric material.

25. A method of claim 18 in which the temperature of the heated gaseous stream is maintained within a range of 1 degrees C. across the width of the web.

26. A method of claim 18 in which the quenching fluid passed through the web in step 2(b) is a gaseous stream applied to the web under pressure to forcefully move the gaseous stream through the web.

27. A method of claim 26 in which the quenching gaseous stream passed through the web in step 2(b) is at ambient temperature.

28. A method of claim 26 in which the pressure that forcefully moves the quenching gaseous stream through the web is supplied at least in part by gas-withdrawal apparatus positioned below the web in alignment with the quenching gaseous stream.

29. A method of claim 26 in which flow-restricting means is interposed in the path of the quenching gaseous stream at a point after the quenching gaseous stream has passed through the web.

30. A method of claim 29 in which the flow-restricting means comprises a perforated plate.

31. A method of claim 18 in which step 2(a) provides sufficient heating of the fibers to morphologically refine an amorphous-characterized phase of the fibers to provide repeatable bonding between the fibers.

32. A bonded nonwoven fibrous web comprising softenable oriented monocomponent semicrystalline polymeric fibers selected from the group consisting of nylon fibers, polypropylene fibers, polyethylene fibers, and polyethylene terephthalate fibers, the fibers exhibiting a Differential Scanning calorimetry (DSC) scan having an exothermic crystal-perfection peak in a non-reversing heat flow plot and a basic melting point appearing as a single endothermic peak in a total heat flow plot, and further exhibiting a Nominal Melting Point as defined herein with the proviso that for nylon fibers the Nominal Melting Point be determined from a first-heat total-heat-flow plot, further wherein the crystal-perfection peak shows:

i) a first discernible crystal perfection peak in the non-reversing heat flow plot corresponding to an amorphous-characterized phase that exhibits repeatable softening, and ii) a second discernible crystal perfection peak in the non-reversing heat flow plot corresponding to a crystallite-characterized phase that reinforces the fiber structure during softening of the amorphous-characterized phase, wherein the highest point of the crystal perfection exothermic peak is positioned at a temperature as high or higher than the Nominal Melting Point, whereby the fibers may be autogenously bonded while retaining orientation and fiber structure.

33. A fibrous web of claim 32 comprising a semicrystalline polymer selected from nylon, polypropylene or polyethylene terephthalate, wherein a temperature spread between maxima of the crystal-perfection peak corresponding to the amorphous-characterized phase and the crystallite-characterized phase is between about 6 to 9° C. when the polymer is nylon, at least 4° C. when the polymer is polypropylene, and at least about 5° and up to about 10° C. when the polymer is polyethylene terephthalate.

34. A fibrous web of claim 32 in which the fibers soften to a bondable state at a temperature at least 50° C. lower than the Nominal Melting Point of the fibers.

35. A fibrous web of claim 32 in which the fibers have their original fiber cross-section in the interval between bonds.

36. A fibrous web of claim 32 molded to a nonplanar shape, the fibers having retained orientation and fiber structure.

37. A fibrous web of claim 32 having a thickness of about one millimeter or less.

38. A nonwoven fibrous web comprising bonded oriented monocomponent semicrystalline polymeric fibers selected from the group consisting of nylon fibers, polyethylene fibers, and polypropylene fibers, the fibers exhibiting a Differential Scanning calorimetry (DSC) scan having an exothermic crystal-perfection peak in a non-reversing heat flow plot and a basic melting point appearing as a single endothermic peak in a total heat flow plot, and further exhibiting a Nominal Melting Point as defined herein with the proviso that for nylon fibers the Nominal Melting Point be determined from a first-heat total-heat-flow plot, the crystal-perfection peak showing:

a) a first discernible crystal perfection peak in the non-reversing heat flow plot corresponding to an amorphous-characterized phase that exhibits repeatable softening, and b) a second discernible crystal perfection peak in the non-reversing heat flow plot corresponding to a crystallite-characterized phase that reinforces the fiber structure during softening of the amorphous-characterized phase, wherein the highest point of the crystal perfection exothermic peak is positioned at a temperature as high or higher than the Nominal Melting Point, whereby the fibers may be autogenously bonded while retaining orientation and fiber structure; and further wherein the fibers further exhibit a Distinguishing DSC Characteristic in which one or both of an increase in the height of the cold crystallization peak, and a shift in the exothermic crystal-perfection peak such that the greatest height of the crystal-perfection peak is above the Nominal Melting Point, is observed in a second-heat total-heat DSC scan of the fibers, with the proviso that the Nominal Melting Point is determined from a first-heat total-heat-flow DSC scan if the fibers are nylon fibers, the web being capable of replicating a nonplanar shape in a molding operation at a temperature at least 15 degrees C. less than the Nominal Melting Point of the fibers.

39. A nonwoven fibrous web of claim 38 capable of replicating a nonplanar shape in a molding operation at a temperature at least 50 degrees C. less than the Nominal Melting Point of the fibers.

40. A method for forming a bondable and shapeable fibrous web, the method comprising morphologically refining a web comprised of oriented monocomponent semicrystalline polymeric fibers selected from the group consisting of nylon fibers, polypropylene fibers, polyethylene fibers, and polyethylene terephthalate fibers, by forcefully passing heating and quenching gaseous streams through the web so that said fibers of said morphologically refined web exhibit a Differential Scanning calorimetry (DSC) scan having an exothermic crystal-perfection peak in a non-reversing heat flow plot and a basic melting point appearing as a single endothermic peak in a total heat flow plot, and further exhibiting a Nominal Melting Point as defined herein with the proviso that for nylon fibers the Nominal Melting Point be determined from a first-heat total-heat-flow plot, further wherein the crystal-perfection peak shows:

a) a first discernible crystal perfection peak in the non-reversing heat flow plot corresponding to an amorphous-characterized phase that exhibits repeatable softening, and b) a second discernible crystal perfection peak in the non-reversing heat flow plot corresponding to a crystallite-characterized phase that reinforces the fiber structure during softening of the amorphous-characterized phase, wherein the highest point of the crystal perfection exothermic peak is positioned at a temperature as high or higher than the Nominal Melting Point, whereby the fibers may be autogenously bonded while retaining orientation and fiber structure, and wherein said heating gaseous stream heats the fibers to a temperature as high or higher than the Nominal Melting Point of the fibers for a time sufficient to melt lower-order crystallites in the fibers but too short to wholly melt the fibers, further wherein said fibers of said morphologically refined web are capable of developing autogenous bonds at a temperature at least 15 degrees C. less than the Nominal Melting Point of the fibers.

41. A method for molding a web comprised of oriented monocomponent semicrystalline polymeric fibers selected from the group consisting of nylon fibers, polypropylene fibers, polyethylene fibers, and polyethylene terephthalate fibers, the method comprising:

a) morphologically refining the web by forcefully passing heating and quenching gaseous streams through the web so that said fibers exhibit a Differential Scanning calorimetry (DSC) scan having an exothermic crystal-perfection peak in a non-reversing heat flow plot and a basic melting point appearing as a single endothermic peak in a total heat flow plot, and further exhibiting a Nominal Melting Point as defined herein with the proviso that for nylon fibers the Nominal Melting Point be determined from a first-heat total-heat-flow plot, the crystal-perfection peak showing:

i) a first discernible crystal perfection peak in the non-reversing heat flow plot corresponding to an amorphous-characterized phase that exhibits repeatable softening, and ii) a second discernible crystal perfection peak in the non-reversing heat flow plot corresponding to a crystallite-characterized phase that reinforces the fiber structure during softening of the amorphous-characterized phase, wherein the highest point of the crystal perfection exothermic peak is positioned at a temperature as high or higher than the Nominal Melting Point, whereby the fibers may be autogenously bonded while retaining orientation and fiber structure, wherein said heating gaseous stream heats the fibers to a temperature as high or higher than the Nominal Melting Point of the fibers for a time sufficient to melt lower-order crystallites in the fibers but too short to wholly melt the fibers, whereby the fibers are capable of developing autogenous bonds at a temperature at least 15 degrees C. less than the Nominal Melting Point of the fibers;

b) placing the web in a mold; and c) subjecting the web to a molding temperature as high or higher than the Nominal Melting Point of the fibers, wherein the molding temperature is effective to permanently convert the web into the mold shape.

* * * * *

UNITED STATES PATENT AND TRADEMARK OFFICE

CERTIFICATE OF CORRECTION

PATENT NO. : 9,139,940 B2
APPLICATION NO. : 11/461201
DATED : September 22, 2015
INVENTOR(S) : Michael Berrigan It is certified that error appears in the above-identified patent and that said Letters Patent is hereby corrected as shown below:

Title Page, Column 1
Line 1, (Assignee section), delete "company," and insert -- Company --

Page 2, Column 1
Line 10, (Other Publications) delete "Terperature" and insert -- Temperature --

Line 19, (Other Publications) delete "Termperatures" and insert -- Temperatures --

In The Specification

Column 4
Line 32, delete "calorimetry" and insert -- Calorimetry --

Column 17
Line 56, delete "milliimeter" and insert -- millimeter --

Lines 59-60, delete "milliimeter" and insert -- millimeter --

Column 23
Line 36, delete "Holingsworth" and insert -- Hollingsworth --

Line 51, delete "MDSCT" and insert -- MDSC™ --

In The Claims

Column 28
Line 23, in claim 13, delete "in which in which" and insert -- in which --

Line 59, in claim 18, delete "calorimetry" and insert -- Calorimetry --

Signed and Sealed this
First Day of March, 2016

Michelle K. Lee

Michelle K. Lee
*Director of the United States Patent and Trademark Office*

Column 30
Line 8, in claim 32, delete “calorimetry” and insert -- Calorimetry --

Line 52, in claim 38, delete “calorimetry” and insert -- Calorimetry --

Column 31
Line 31, in claim 40, delete “calorimetry” and insert -- Calorimetry --

Column 32
Lines 16-17, in claim 41, delete “calorimetry” and insert -- Calorimetry --